US009213301B2

(12) United States Patent
Kudo et al.

(10) Patent No.: US 9,213,301 B2
(45) Date of Patent: Dec. 15, 2015

(54) IMAGE FORMING APPARATUS

(71) Applicant: CANON KABUSHIKI KAISHA, Tokyo (JP)

(72) Inventors: Ran Kudo, Tokyo (JP); Jirou Makinodan, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/495,161

(22) Filed: Sep. 24, 2014

(65) Prior Publication Data

US 2015/0086235 A1 Mar. 26, 2015

(30) Foreign Application Priority Data

Sep. 25, 2013 (JP) ..... 2013-198928

(51) Int. Cl.
*G03G 15/16* (2006.01)
*G03G 21/10* (2006.01)

(52) U.S. Cl.
CPC ..... *G03G 21/105* (2013.01); *G03G 2215/0132* (2013.01)

(58) Field of Classification Search
CPC ..... G03G 15/161; G03G 15/168; G03G 15/0189; G03G 2215/1661
USPC ..... 399/101
See application file for complete search history.

(56) References Cited

U.S. PATENT DOCUMENTS

| | | | | |
|---|---|---|---|---|
| 5,659,851 | A * | 8/1997 | Moe et al. | 399/165 |
| 8,805,266 | B2 | 8/2014 | Sato | |
| 2006/0045561 | A1* | 3/2006 | Takayama et al. | 399/101 |
| 2009/0154957 | A1* | 6/2009 | Furuya | 399/121 |
| 2010/0080615 | A1* | 4/2010 | Kikuchi | 399/111 |
| 2011/0293316 | A1* | 12/2011 | Sato | 399/101 |
| 2012/0114368 | A1* | 5/2012 | Koide et al. | 399/101 |

FOREIGN PATENT DOCUMENTS

| | | | |
|---|---|---|---|
| JP | 9-169449 | A | 6/1997 |
| JP | 2000-259053 | A | 9/2000 |
| JP | 2001-146335 | A | 5/2001 |
| JP | 2001-520611 | A | 10/2001 |
| JP | 2011-248137 | A | 12/2011 |

* cited by examiner

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

An image forming apparatus includes; a belt unit detachably mountable to a main assembly, said belt unit including a movable endless belt, a belt supporting roller, a steering unit for swinging the belt to incline relative to the supporting roller by a force produced by movement of the belt in a widthwise direction, and a cleaning unit, supported by the steering unit, for removing and collecting toner from the belt; a toner receiving unit, provided in the assembly, for receiving the toner collected by the cleaning unit; and a path member for guiding the toner collected by the cleaning unit to the toner receiving unit, the path member being supported by the assembly when the belt unit is not mounted, and the path member being supported by the cleaning swingably relative to the toner receiving unit when the belt unit is mounted.

10 Claims, 17 Drawing Sheets

(a)

(b)

(a)

(b)

(a)

(b)

(a)

(b)

(a)

(b)

IMAGE FORMING APPARATUS

FIELD OF THE INVENTION AND RELATED ART

The present invention relates to an image forming apparatus using an electrophotographic type such as a copying machine, a facsimile machine or a printer, including a rotatably endless belt such as an intermediary transfer belt.

In the image forming apparatus using the electrophotographic type, a so-called intermediary transfer type is known in which a full-color toner image is formed on an endless intermediary transfer belt (ITB). In such an image forming apparatus, the intermediary transfer belt is stretched by a plurality of stretching rollers. With such a structure, a so-called a belt offset may occur, that is, the intermediary transfer belt offsets or shifts to one of the opposite axial end portions during the traveling drive thereof, due to an outer diameter accuracy of the stretching roller, and/or relative alignment accuracy between the rollers, or the like.

Japanese Laid-open Patent Application Hei 9-169449 discloses, as means for overcoming the belt offset, a belt drive control device effecting a steering roller control by an actuator. In such a belt drive control device, a control parameter such as a sampling cyclic period or a control gain of the belt drive control device is switched when at least two of a snaking amount of a belt member, a snaking displacement amount and a snaking speed decreases to predetermined values. By doing so, a responsivity and position correction accuracy against the belt snaking in a transition state is improved, so that high frequency vibrations of the belt in a stable state is suppressed.

In addition, an image forming apparatus including a belt offset limiting member is proposed. In such an image forming apparatus, a belt offset limiting member is provided at each of the opposite axial end portions of a follower roller stretching a recording material feeding belt. A circumferential length of the regulating member is substantially a reciprocal of an integer or an integer multiple of a distance between transfer positions on the recording material feeding belt where the photosensitive drums are opposed. By this, at each of the transfer positions, a deflection due to the snaking becomes constant, so that a color misregistration between different color images in the main scan direction due to the snaking of the recording material feeding belt can be compensated for (Japanese Laid-open Patent Application 2001-146335).

Furthermore, Japanese Laid-open Patent Application 2001-146335, discloses a belt steering device for intermediary transfer belt, using a belt offset control method in which the number of parts is small, and therefore, the belt offset control method may be simple and low cost. This belt steering device uses a type (belt self-alignment) disclosed in JP 2001-520611 in which a steering roller as a steering member automatically effects a belt alignment, using a balance of frictional forces.

With the belt steering device disclosed in JP 2001-520611, the following structure is necessary in order to contact to a steering roller portion a belt cleaner for collecting remaining toner from the intermediary transfer belt, for example. More particularly, a relaying portion for relaying the collected toner to the toner collection container in a main assembly has to be provided on the steering portion.

In this case, since positions of the belt cleaner and the belt cleaning device moves relative to the toner collection container by a steering operation, a gap may be produced at the collected toner relaying portion, or the collected toner scatters in the main assembly.

Therefore, in order to prevent the production of the gap at the collected toner relaying portion even during the steering operation, it would be considered that the deformation amount of the sealing member is made larger. Then, the force required to compress the sealing member becomes an additional load against the steering operation with the possible result of steering malfunction.

SUMMARY OF THE INVENTION

According to an aspect of the present invention, there is provided an image forming apparatus comprising a main assembly; a belt unit detachably mountable to said main assembly, said belt unit including a movable endless belt, a supporting roller supporting said endless belt, a steering unit, supporting said endless belt, for swinging said endless belt to incline relative to said supporting roller by a force produced by movement of said endless belt in a widthwise direction which crosses with a moving direction of said endless belt, and a cleaning unit, supported by said steering unit, for removing and collecting toner from said endless belt; an image forming station for forming a toner image on said endless belt; a toner receiving unit, provided in said main assembly, for receiving the toner collected by said cleaning unit; and a path member for guiding the toner collected by said cleaning unit to said toner receiving unit, said path member being supported by said main assembly when said belt unit is not mounted to said main assembly, and said path member being supported by said cleaning unit in a state that said path member is swingable relative to said toner receiving unit when said belt unit is mounted to said main assembly.

These and other objects, features and advantages of the present invention will become more apparent upon a consideration of the following description of the preferred embodiments of the present invention taken in conjunction with the accompanying drawings.

DESCRIPTION OF THE EMBODIMENTS

Figure 1:
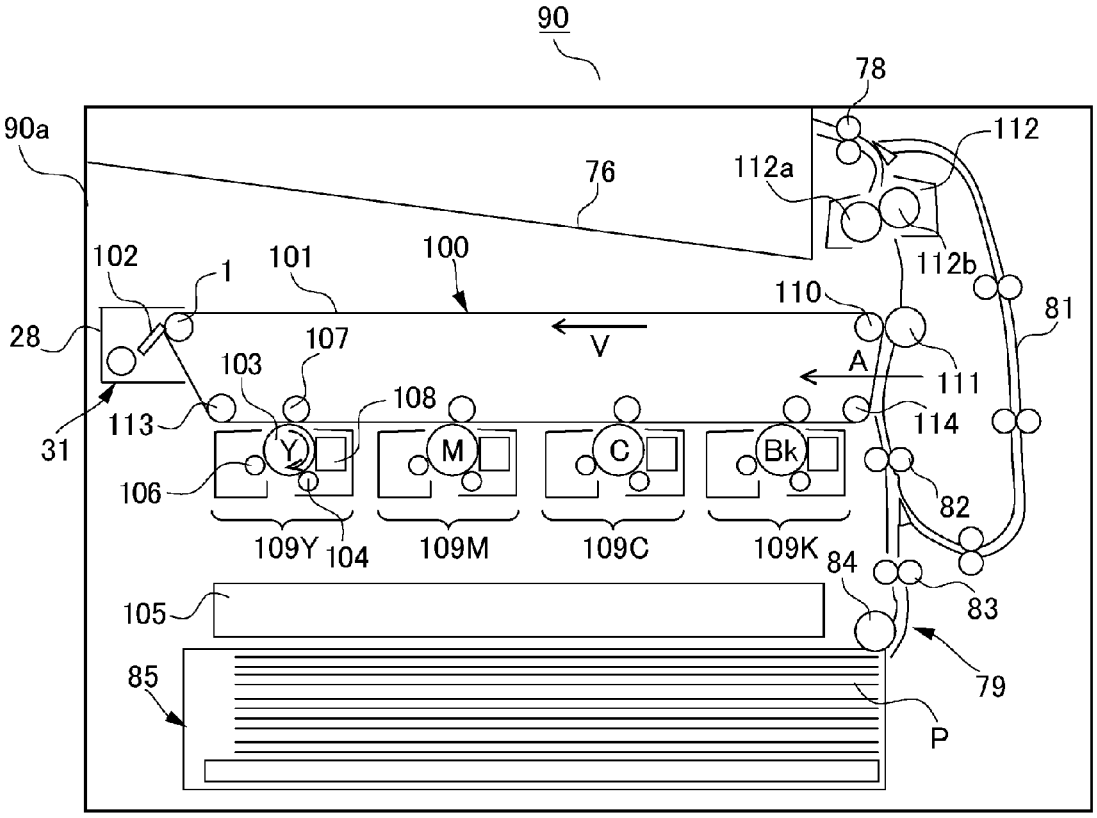
FIG. 1 is a schematic illustration of an image forming apparatus according to an embodiment of the present invention.

An embodiment of an image forming apparatus including a belt unit according to the present invention will be described in conjunction with the accompanying drawings. FIG. 1 is a general arrangement of an image forming apparatus 90 according to this embodiment. In the description of embodiments, the same reference numerals are assigned to the elements having the corresponding functions in this embodiment, and the detailed description thereof is omitted for simplicity.

[Structure of Image Forming Apparatus]

The image forming apparatus 90 of this embodiment is an electrophotographic type copying machine which forms an image on a recording material P in the form of a sheet which is a recording material in accordance with an image signal fed from computer (unshown) or the like. The image forming apparatus 90 is of a so-called intermediary transfer and tandem type in which four color image forming stations are provided on an intermediary transfer belt.

Figure 6:
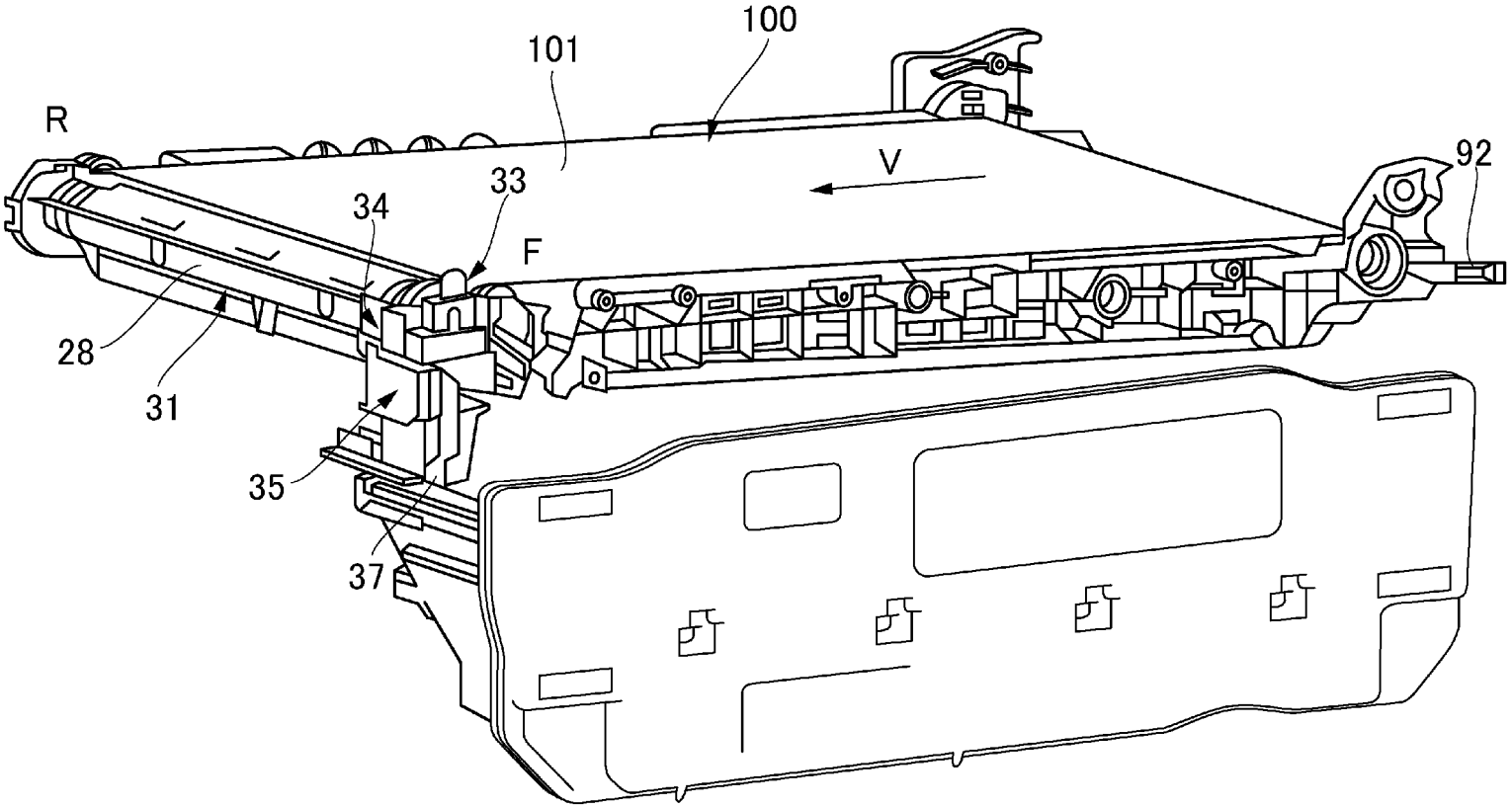
FIG. 6 is a perspective view of a collected toner feeding portion in this embodiment.

Image forming apparatus 90 comprises a main assembly of the image forming apparatus 90*a* (main assembly 90*a*) in which an intermediary transfer belt unit 100 as the belt unit is detachably provided in main assembly 90*a* at a middle level. The intermediary transfer belt unit 100 is supported on a supporting frame (unshown) in the main assembly 90*a* when mounted to the main assembly 90*a*, and a cleaner container 28 of a belt cleaning device 31 is connected with a path portion 33 (FIG. 6).

A steering unit 1 supports an intermediary transfer belt 101 as a rotation endless belt together with a secondary-transfer inside roller 110. It swings to change an alignment relative to the secondary-transfer inside roller 110 to control the position of the intermediary transfer belt 101 in a widthwise direction which is crossing with (perpendicular to) a circumferential direction thereof.

That is, the steering unit 1 rotatably supports the intermediary transfer belt 101 together with the secondary-transfer inside roller 110. The secondary-transfer inside roller 110 functions as a supporting roller supporting the intermediary transfer belt 101 so as to be rotatable in the circumferential direction. The steering unit 1 swings to change the alignment relative to the secondary-transfer inside roller 110 so that the position of the intermediary transfer belt 101 in the widthwise direction crossing with (perpendicular to) the circumferential direction. Is secondary-transfer inner roller 110 in this embodiment functions also as a driving roller for driving the intermediary transfer belt 101.

Below the intermediary transfer belt unit 100, there are provided four image forming stations 109Y, 109M, 109C and 109K in the order named from an upstream side to a downstream side along a rotational moving direction (arrow V) of the intermediary transfer belt 101. The image forming stations 109Y-109K form images (toner images) on the intermediary transfer belt 101 while it is being fed.

More particularly the image forming stations 109Y, 109M, 109C, 109K form yellow, magenta, cyan and black toner images in this order. The image forming stations 109Y-109K include respective drum shape electrophotographic photosensitive members (photosensitive drums) 103 as latent image bearing members. The photosensitive drums 103 are rotated in the clockwise direction in FIG. 1.

The intermediary transfer belt unit 100 includes the secondary-transfer inner roller 110, a stretching roller 114, a stretching roller 113 and the steering unit 1. The intermediary transfer belt 101 is stretched (supported) by a follower roller 2 (FIG. 2) of the steering unit 1 and the rollers 110, 113, 114 so as to be rotatable in the circumferential direction. The intermediary transfer belt 101 receives an outward tension by the follower roller 2 of the steering unit 1 functioning also as a tension roller.

On the inner surface of the intermediary transfer belt 101 between the stretching roller 114 and the stretching roller 113, four primary transfer rollers 107 are provided corresponding to the image forming stations 109Y-109K, respectively. Each primary transfer roller 107 is supplied with a transfer bias by a bias applying means (unshown).

At the position opposed to the respective primary transfer rollers 107 across from the intermediary transfer belt 101, the photosensitive drums 103 are disposed. The intermediary transfer belt 101 is pressed by the primary transfer rollers 107 at the back side (inner surface), so that the front side thereof is contacted to the photosensitive drums 103 of the image forming stations 109Y-109K.

Thus, between the photosensitive drum 103 with intermediary transfer belt 101, primary transfer nips as primary transfer portions are formed. The intermediary transfer belt 101 is rotated by the rotation of the secondary-transfer inside roller 110 as the driving roller in the counterclockwise direction, in the same peripheral moving direction. A rotational speed of the intermediary transfer belt 101 is substantially the same as a rotational speed (process speed) of the photosensitive drums 103.

Around each of the four photosensitive drums 103, there are provided a charging roller 104 as charging means, an exposure device 105 as exposure means, a developing device 106 as developing means and a photosensitive member cleaner 108, in the order named along the rotational moving direction thereof.

The exposure devices 105 are supplied with image signals of yellow, magenta, cyan and black colors, and exposes the surfaces of the photosensitive drum 103 with laser beams in accordance with the respective image signals to neutralize the electric charge, thus forming electrostatic latent images.

At a position across the intermediary transfer belt 101 from the secondary-transfer inside roller 110, a secondary-transfer outside roller 111 is provided. The secondary-transfer outside roller 111 nips the intermediary transfer belt 101 with the secondary-transfer inside roller 110 and applies an external force to the secondary-transfer inside roller 110 the intermediary transfer belt 101 to form a secondary transfer nip as a secondary transfer portion.

The secondary transfer portion secondary-transfers the toner image formed on the intermediary transfer belt 101 onto a recording material (sheet) P fed from a feeding portion 79 which will be described hereinafter. To the secondary-transfer outside roller 111 in the secondary transfer portion, a positive bias voltage is applied. By the application of the positive bias to the secondary transfer portion the secondary-transfer outside roller 111, the four color toner images are secondary-transferred onto the recording material P fed by a pair of registration rollers 82 from the intermediary transfer belt 101.

To the surface of the intermediary transfer belt 101 at the position opposing the steering unit 1, a cleaning blade 102 of the belt cleaning device 31 is contacted. The cleaning blade 102 applies an external force to the steering unit 1 the intermediary transfer belt 101.

Downstream of the secondary transfer portion with respect to the feeding direction of the recording material, a fixing device 112 including a fixing roller 112*a* and a pressing roller 112*b* contained in a casing is provided. Furthermore, downstream of the fixing device 112, a pair 78 of sheet discharging rollers and a sheet discharge tray 76 are provided.

The recording material P carrying a secondary-transferred toner image is fed into a fixing nip formed between the fixing roller 112*a* and the pressing roller 112*b*, and the toner image is heated and pressed between the rollers 112*a*, 112*b* so as to be fused and fixed on the recording material P.

In addition, below the main assembly 90*a*, a feeding portion 79 including a sheet feeding cassette 85 stacking the recording materials P is provided. In the feeding portion 79, the recording materials P are fed one by one out of the sheet feeding cassette 85 toward the registration roller through the sheet feeding roller 84 and a feeding roller 83, and are supplied to the secondary transfer portion by the registration roller pair 82 at predetermined timings.

[Image Formation Process]

An image forming process up to the secondary transfer portion will be described. The image forming station 109Y, the image forming station 109M, the image forming station 109C and the image forming station 109K have similar structures except that the colors of the toner are different.

The photosensitive drum 103 rotating in the clockwise direction in the Figure is uniformly charged by the charging roller 104. The exposure device 105 is driven on the basis of the inputted image information signal to expose the charged photosensitive drum 103, thus forming the electrostatic latent image on the surface of the photosensitive drum. The electrostatic latent image formed on the photosensitive drum is developed by the developing device 106 into a toner image on the photosensitive drum 103.

Continuously, a yellow toner image is primary-transferred onto the intermediary transfer belt 101 by a predetermined pressure and an electrostatic load bias provided by the primary transfer roller 107. Thereafter, untransferred toner remaining on the photosensitive drum 103 is collected by the photosensitive member cleaner 108 to be prepared for the next image forming operation.

The image forming stations 109 described above include four stations for yellow (Y), magenta (M), cyan (C) and black (Bk) colors. Therefore, onto the yellow toner image formed on the intermediary transfer belt 101, the magenta toner image formed by the image forming station 109M is transferred onto the intermediary transfer belt 101. Onto the magenta toner image is thus formed, a cyan toner image formed in the image forming station 109C is transferred onto the intermediary transfer belt 101.

Furthermore, onto the cyan toner image, a black toner image formed by the image forming station 109K is transferred onto the intermediary transfer belt 101. In this manner, different color toner images are superimposedly transferred onto the intermediary transfer belt 101, so that a full-color image is formed on the intermediary transfer belt 101. The number of the colors is four in this embodiment, but the number is not limited to this, and the order of the colors is not limited to the above-described.

The image forming processes for respective colors which are carried out concurrently by the image forming stations 109Y-109K at such timings that the images are superposed on the intermediary transfer belt 101 after the primary-transfer. As a result, finally, full-color toner images are formed on the intermediary transfer belt 101 and are fed to the secondary transfer portion.

[Process after Secondary-Transfer]

In the secondary transfer portion, the secondary transfer nip is supplied with an electrostatic load bias voltage and a predetermined pressure, by which the full-color toner image formed on the intermediary transfer belt 101 is secondary-transferred onto the recording material. Thereafter, the recording material P is fed to the fixing device 112, where is subjected to the predetermined pressure and heat quantity between the rollers 112*a*, 112*b*, by which the toner image is fused and fixed.

The untransferred toner remaining on the intermediary transfer belt 101 after the secondary-transfer is collected by the cleaning blade 102 to prepare for the next image forming operation. The cleaning blade 102 of this embodiment made of urethane rubber is disposed opposed to the steering unit 1 at an angle counter-directional to the feeding direction of the intermediary transfer belt 101 (counterclockwise direction in FIG. 1).

The cleaning blade 102 is supported so as to integrally swing together with a mechanism (unshown) of the steering unit 1. The cleaning blade 102 keeps in contact with the intermediary transfer belt 101 even when the steering unit 1 is inclined in the axial direction, and therefore, the untransferred toner can be collected.

[Detailed Structure of the Intermediary Transfer Belt]

The detailed structure of the intermediary transfer belt 101 will be described. The intermediary transfer belt 101 is an endless belt which travels in the direction indicated by a arrow V in FIG. 1 and which is supported and stretched by the secondary-transfer inside roller 110 as the supporting roller, the steering unit 1 as the steering member and the stretching rollers 113, 114 as the stretching members.

In this embodiment, as described before, the secondary-transfer inside roller 110 functions also as a driving roller, and the steering unit 1 functions also as a tension roller for applying a predetermined tension to the inner surface of the intermediary transfer belt 101. The number of the rollers stretching the intermediary transfer belt 101 is not limited to that of the structure shown in FIG. 1.

The material of the intermediary transfer belt 101 is selected from the standpoint of avoiding production of the creases of the belt during the rotation. More particularly, the desirable materials are PVDF (polyvinylidene fluoride), polyamide, polyimide, PET (polyethylene terephthalate), polycarbonate or the like, which has a high stiffness.

The thickness of the intermediary transfer belt 101 is as follows. If it is too thin, the wearing deprives it of sufficient durability, and if it is too thick, the belt does not bend smoothly at the secondary-transfer inside roller 110, the steering unit 1 or the stretching rollers 113, 114 with the possible result that it will be dimpled or folded. For this reason, the thickness is desirably within the range of 0.02 mm-0.50 mm, for example. In this embodiment, the intermediary transfer belt 101 is a resin material belt having a base layer comprising polyimide and a stretching modulus of elasticity of E=18000 N/cm♂2♂, and a film thickness of 0.08 mm.

[Steering Structure of Intermediary Transfer Belt]

Figure 2:
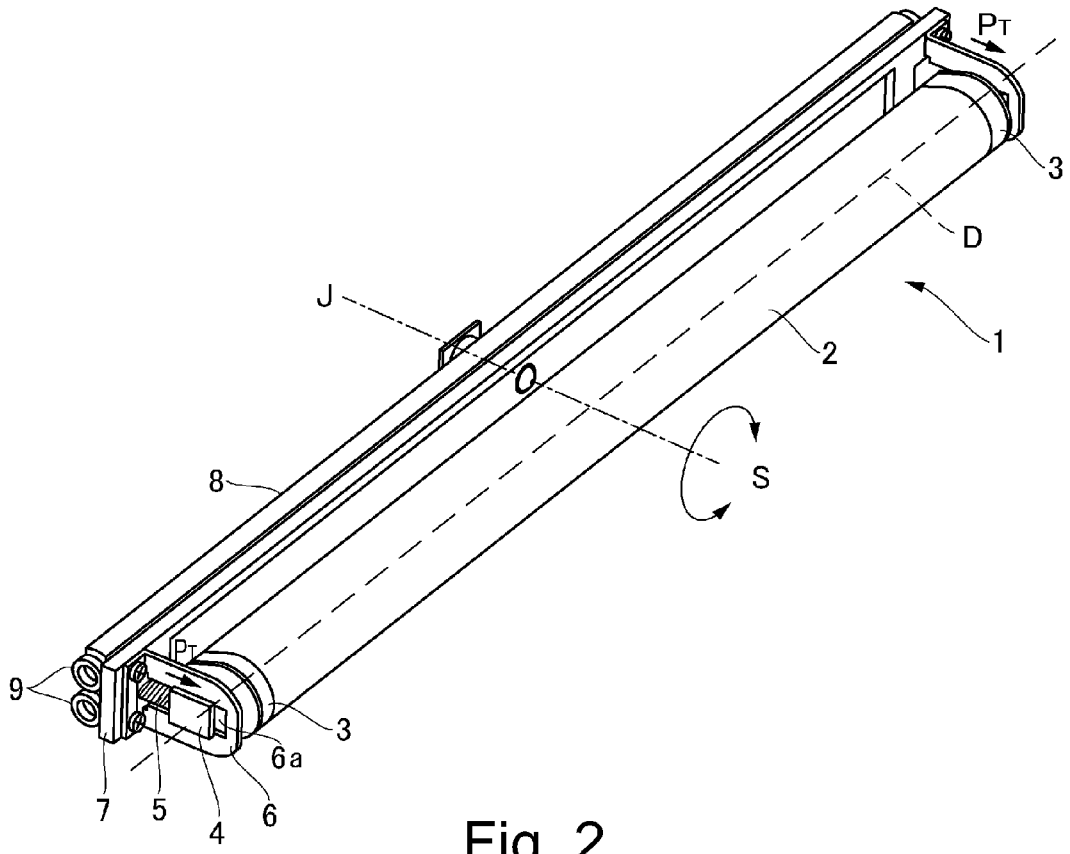
FIG. 2 is a perspective view of an automatic alignment mechanism in this embodiment.

Referring to FIG. 2, the steering structure of the intermediary transfer belt 101 will be described. FIG. 2 is a perspective view illustrating an automatic alignment mechanism in this embodiment.

The steering unit 1 includes a rotation plate (supporting member) 7 having a steering axis (rotational shaft) J rotatably supporting an entirety of the roller at a central portion with respect to the axial direction (D). The steering unit 1 includes a follower roller 2 functioning also as a tension roller, which is rotated by the intermediary transfer belt 101 in the state that is rotatably supported by the rotation plate 7. Furthermore, the steering unit 1 includes sliding ring portion 3 (3*a*, 3*b*) as a fixed member provided at each of the opposite axial end portions of the follower roller 2 and having a larger frictional resistance relative to the intermediary transfer belt 101 than the follower roller 2. The rotation plate 7 supports the follower roller 2 and the sliding ring portion 3 (3*a*, 3*b*) rotatably about the steering axis (rotational shaft) extending in a direction crossing with the rotational axis of the follower roller 2.

That is, as shown in FIG. 2, in the steering unit 1, the follower roller 2 as a center portion rotatable portion and the sliding ring portion 3 at the opposite end portions of follower roller 2 (with respect to the rotational axis direction, that is, broken line D direction) are co-axially connected.

A frame stay 8 constituting a part of the casing of the intermediary transfer belt unit 100 (FIG. 1) is extended between both side plates of the belt unit 100. At the opposite longitudinal end portions of the frame stay 8, two slide rollers 9 are rotatably supported, respectively.

A rotation plate 7 is provided opposed to the frame stay 8. The rotation plate 7 is pivotable or swingable to the left and right about the steering axis J in FIG. 2. In the swing motion, the slide rollers 9 function to reduce rotation resistances relative to frame stay 8.

At the opposite end portions of the rotation plate 7, side supporting members 6 are fixed thereto, and the side supporting members 6 are provided with respective slide groove portions 6*a*. The slide groove portions 6*a* are slidably engaged with slide bearing members 4, respectively. Each slide bearing member 4 is slidably urged in the direction indicated by an arrow PT in the Figure by a tension spring (compression spring) 5 as an elastic member.

The side supporting member 6 and the rotation plate 7 constitutes a supporting table supporting the follower roller 2 and the sliding ring portion (fixed member) 3. The side supporting member 6 it supported by the steering shaft (rotational shaft) 21 (FIG. 3) so as to be swingable in the direction indicated by an arrow S in the Figure with respect to the steering axis J crossing with (perpendicular to) the axial direction at the axially central portion of the steering unit le.

[Detail Structure of Automatic Alignment Mechanism]

Figure 3:
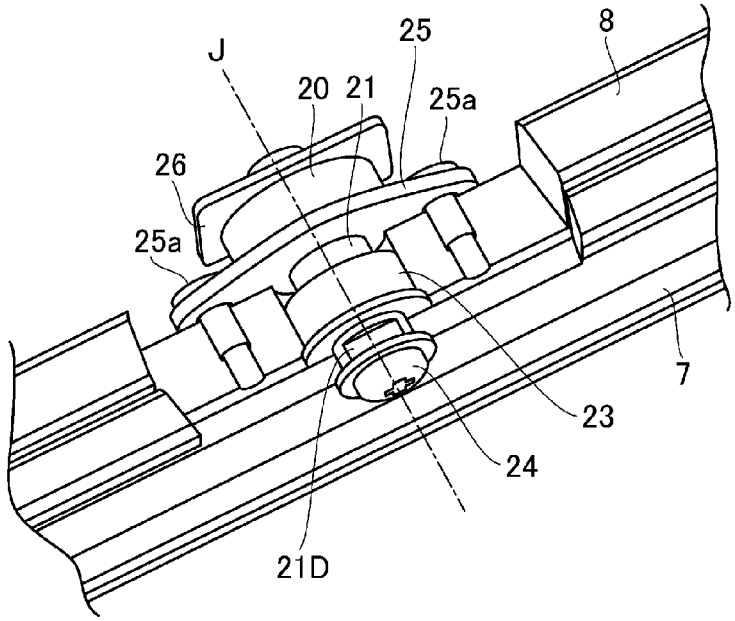
FIG. 3 is a perspective view of a central portion of the automatic alignment mechanism in this embodiment.
Figure 4:
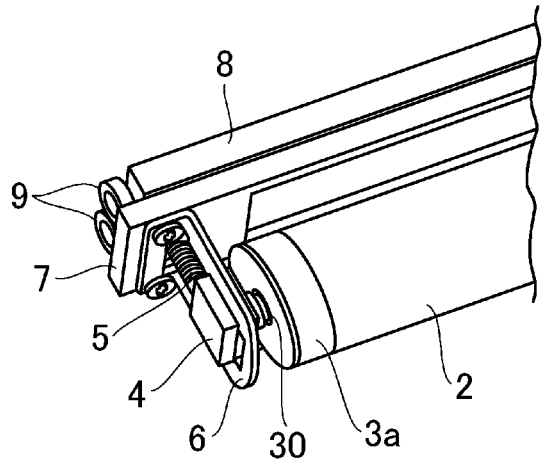
In FIG. 4, (a) is a perspective view of a straight type sliding ring portion of the automatic alignment mechanism in this embodiment, and (b) is a perspective view of a taper type sliding ring portion of the automatic alignment mechanism.
Figure 4:
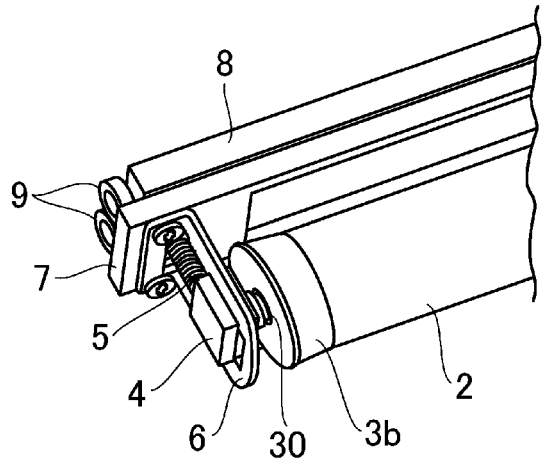
Figure 5:
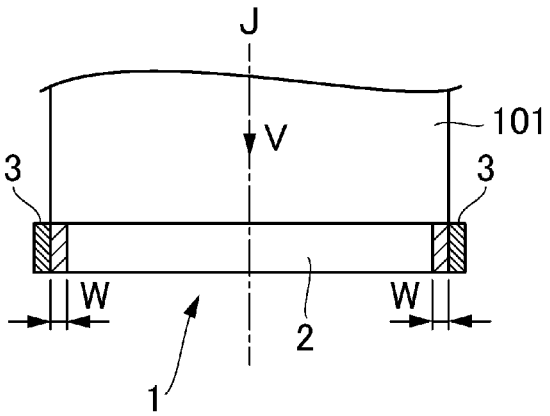
In FIG. 5, (a) and (b) are illustrations of relationships between an intermediary transfer belt and a sliding ring.
Figure 5:
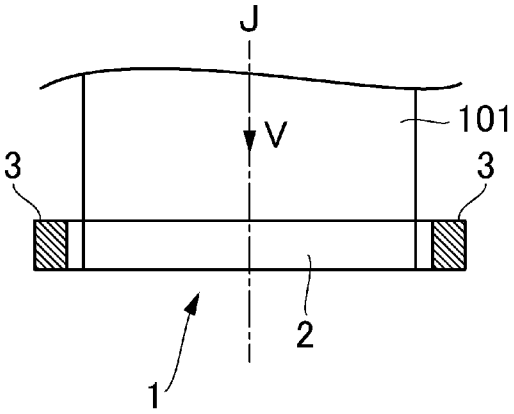

Referring to FIGS. 3-5, the structure of the automatic alignment mechanism will be described in detail. FIG. 3 is a sectional view illustrating a structure of the swing central portion of the supporting table constituted by the side supporting member 6 and the rotation plate 7. Part (a) of FIG. 4 is a perspective view showing a straight type sliding ring portion of the automatic alignment mechanism, and part (b) is a perspective view illustrating a taper type sliding ring portion of the automatic alignment mechanism. Parts (a) and (b) of FIG. 5 are illustrations of an engaging width between the intermediary transfer belt 101 and the sliding ring portion 3.

At the central portion of the rotation plate 7, a steering shaft 21 which is a rotation shaft having a beveled key configuration portion 21D at one end is integrally fastened by screws 24. The steering shaft 21 is inserted into and is supported by a bearing 23 of the frame stay 8.

At the other end portion of the steering shaft 21, a thrust retaining member 26 is fixed a supporting member 20 to retain the steering shaft 21. Reference numeral 25 is a supporting member fixed to the frame stay 8 by screws 25*a* between the frame stay 8 and the supporting member 20, and the steering shaft 21 penetrates the supporting member.

Part (a) of FIG. 4 shows the straight type sliding ring portion 3*a* having a uniform outer diameter distribution with respect to the axial direction of the follower roller 2. Part (b) of FIG. 4 shows the taper type sliding ring portion 3*b* having an outer diameter continuously increasing toward an outside in the axial direction of the follower roller 2.

In part (a) and part (b) of FIG. 4, the follower roller 2 is rotatably supported on a follower roller shaft 30 through an bearing or the like therein. The opposite end portions sliding ring portions 3*a* (and 3*b*) is non-rotatably supported on the follower roller shaft 30 using parallel pins or the like so as not to rotate by the intermediary transfer belt 101.

The end portion of the follower roller shaft 30 is cut into a D-shape so as to be non-rotatable relative to the slide bearing member 4. Therefore, when the intermediary transfer belt 101 stretched by the follower roller 2 and the rollers 113, 114, 110 is rotated, the follower roller 2 does not slide on the inner surface of the belt but the sliding ring portions 3*a* (and 3*b*) slide on the inner surface of the belt.

With such a structure, the automatic belt alignment is accomplished. In this embodiment, when the range in which the sliding ring portion 3 (3*a*, 3*b*) and the intermediary transfer belt 101 exceeds a predetermined level, the steering unit 1 starts the steering operation.

The sliding ring portion 3 (3*a*, 3*b*) may be rotatably supported. In such a case, a torque required to rotate the sliding ring portion 3 in the rotational direction of the intermediary transfer belt 101 has to be larger than a torque required to rotate the follower roller 2 in the same direction, and with such setting, the steering operation is possible.

In this embodiment, the width of the intermediary transfer belt 101 is larger than the width of the follower roller 2 and is smaller than the width of the steering unit 1 (sliding ring portion 3 at the opposite end portions).

Thus, in the ideal normal alignment state, the engaging widths between the intermediary transfer belt 101 and the sliding ring portions 3 are even as shown by widths w in part (a) of FIG. 5 (wide pitch hatching portion in the Figure). With such a relationship, if a belt offset occurs, the intermediary transfer belt 101 is engaged with either one of the sliding ring portions 3.

That is, in this case, during the traveling of the intermediary transfer belt 101, the intermediary transfer belt 101 slides on at least one of or both of the sliding ring portions 3. On the other hand, the width of the intermediary transfer belt 101 is smaller than the width of the follower roller 2 as shown in part (b) of FIG. 5, even if the belt offset occurs, the supporting table (6, 7) does not swing before the intermediary transfer belt 101 comes to engage with the sliding ring portion 3, and therefore, the aligning operation may be abrupt.

In principle, the belt self-alignment using a balance of the frictional forces is capable with the relationship shown in part (b) of FIG. 5. However, the relationship of part (a) of FIG. 5 with which the balance difference can be detected always is preferable because fine aligning operation is possible, and the change of the steering angle with time is not large. In this embodiment, the width of the cleaning blade 102 (FIG. 1) is smaller than the width of the follower roller 2. Arrows V in parts (a) and (b) of FIG. 5 indicate the rotational moving direction of the intermediary transfer belt 101.

[Static Friction Coefficient of Sliding Ring Portion]

A static friction coefficient μs of the sliding ring portion 3 will be described. In the structure shown in part (b) of FIG. 4, in this embodiment using the tapered configuration sliding ring portion 3*b*, μs=0.3 approximately, and the taper angle ϕ=10° approximately. The friction coefficient of the surface of the sliding ring portion 3*b* is larger than the friction coefficient of the surface of the follower roller 2.

The material of the sliding ring portion 3 is resin material, more particularly, polyacetal (POM) having a slidability, which is provided with an electroconductive in consideration of electrostatic problem attributable to triboelectric charge with the intermediary transfer belt 101.

In the case of a straight shape sliding ring portion 3*a* as shown in part (a) of FIG. 4, the static friction coefficient μs is preferably larger than that in the case of the tapered configuration the ring portion 3*b* shown in part (b) of FIG. 4, that is, μs=0.6, for example.

[Static Friction Coefficient of Follower Roller]

A static friction coefficient pSTR of the follower roller 2 will be described. In this embodiment, the material of the follower roller 2 is aluminum having a static friction coefficient μSTR=0.1 approximately, but another material is usable if the static friction coefficient μSTR is smaller than the static friction coefficient μs of the sliding ring portion 3.

A measuring method of the friction coefficients of the sliding ring portion 3 and the follower roller 2 will be described. In this embodiment, a friction coefficient test method stipulated in JIS K7125 for plastic resin material film and sheet. The test piece is the inner surface sheet of the belt member which is a polyimide sheet.

[Structure of Belt Cleaning Device]

Figure 7:
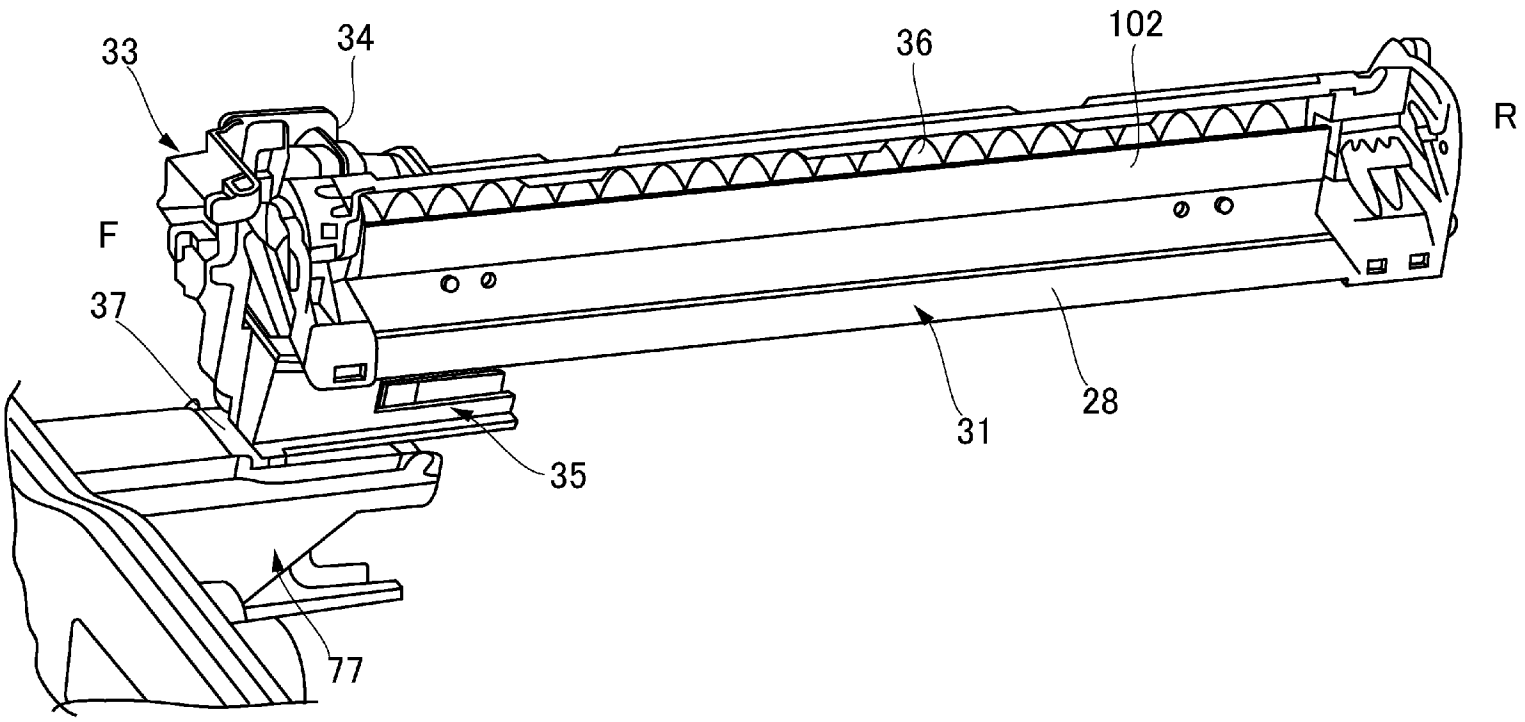
FIG. 7 is a perspective view of the collected toner feeding portion in which an intermediary transfer belt portion is omitted, in this embodiment.

Referring to FIGS. 6 and 7, the structures of the cleaning blade 102 and the neighborhood thereof will be described. FIG. 6 is a perspective view illustrating a collected toner feeding portion according to this embodiment, and FIG. 7 is a perspective view of the collected toner feeding portion, omitting the intermediary transfer belt portion, as seen in the direction of a arrow V of FIG. 6.

In FIG. 6, the remaining toner on the intermediary transfer belt 101 is scraped off by the cleaning blade 102 (FIG. 7) provided in the cleaner container 28 of the belt cleaning device 31 and falls into the cleaner container 28 as collected toner. The collected toner in the cleaner container 28 is fed toward a F side in the Figure by a feeding screw 36 (FIG. 7) extending in the longitudinal direction of the belt cleaning device 31, and is then discharged through a toner discharge opening 31*b* (part (b) of FIG. 12).

The collected toner discharged from the toner discharge opening 31*b* is collected into a collection container 37 (FIG. 10) mounted to the main assembly 90*a* through a path portion 33 comprising a first path member (path member) 34 and a second path member 35. The collection container 37 provided with a cylindrical portion 35*d* (FIG. 9) into which a nozzle portion 34*c* is inserted in a non-contact state through the opening 37*a* so that the nozzle portion 34*c* overlaps the cylindrical portion 35*d* in the height direction.

The belt cleaning device 31 is provided in the intermediary transfer belt unit 100 and includes the cleaner container 28 which is swingable together with the steering unit 1 and which collect the toner from the intermediary transfer belt 101 (endless belt). The cleaner container 28 provided with a shutter member 32 for opening and closing the toner discharge opening 31*b*.

The path portion 33 is detachably mountable to the cleaner container 28 of the belt cleaning device 31 and collects the toner from the cleaner container 28. When the intermediary transfer belt unit 100 is mounted to the main assembly 90*a*, the first path member 34 functioning as path member is connected with the cleaner container 28 from the state that it is temporarily held by the main assembly 90*a*. Thus, when the intermediary transfer belt unit (belt unit) 100 is not mounted to the main assembly 90*a*, the first path member 34 is temporarily held by the main assembly 90*a* so as to be separable from the main assembly 90*a*. The first path member 34 is integrally swingable together with the steering unit 1 and the cleaner container 28, and the toner discharge opening 31*b* is connected with the opening 37*a* to guide the toner fed from the cleaner container 28 into the collection container 37 through the second path member 35. When the belt unit 100 is not mounted to the main assembly 90*a*, the first path member 34 is supported by the main assembly 90*a*, and when the belt unit 100 is supported by the main assembly 90*a*, it is away from the main assembly 90*a*. The first path member 34 is connected with the cleaner container 28 to be swingable integrally with the cleaner container 28, and the toner discharge opening 31*b* is connected with the opening 37*a* to guide the toner from the toner discharge opening 31*b* into the opening 37*a*.

[Detail Structure of Discharging Feeding Path Portion]

Figure 8:
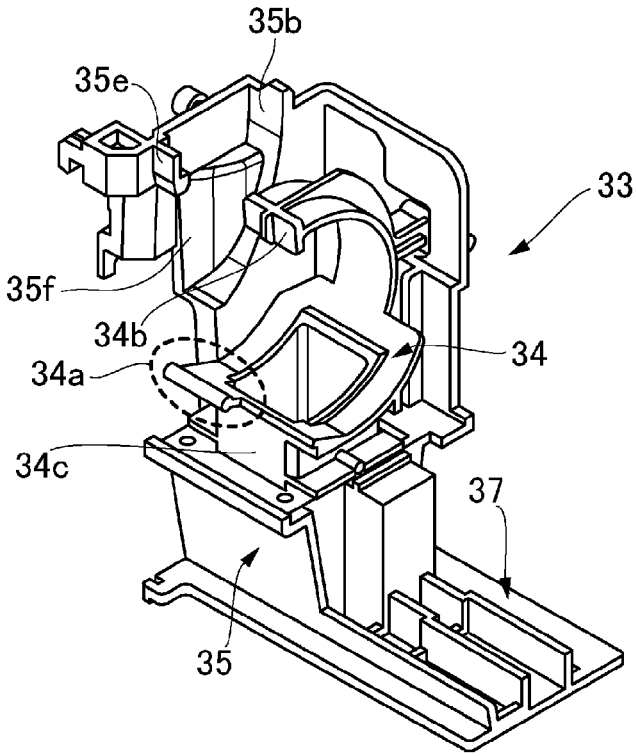
In FIG. 8, (a) is a perspective view of an entirety of a discharging feeding path portion in this embodiment, and (b) is a perspective view of a first path member in (a).
Figure 8:
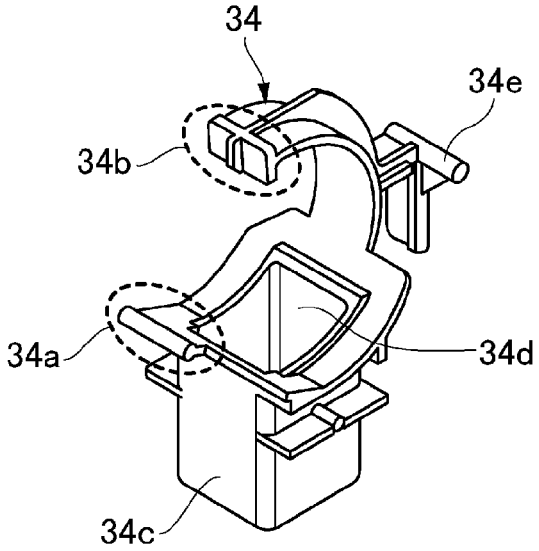
Figure 9:
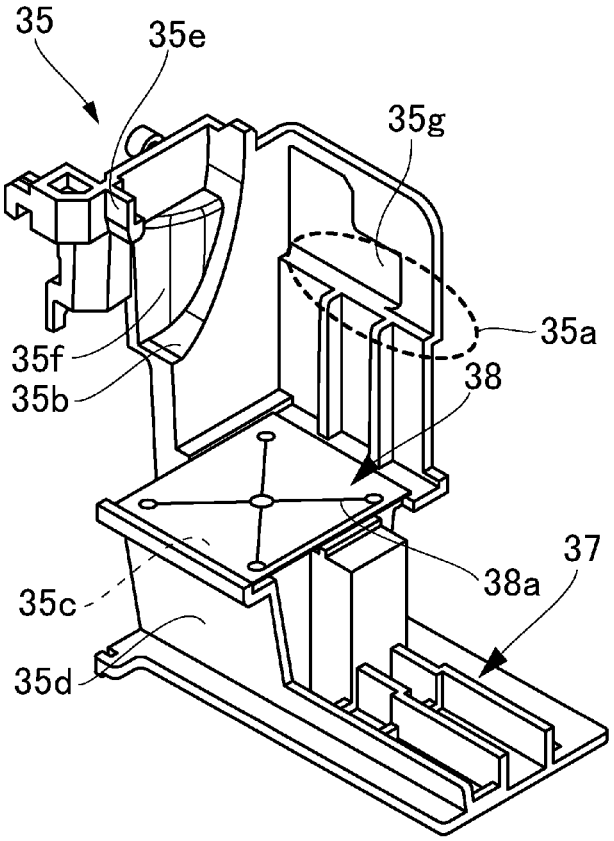
FIG. 9 is a perspective view of a second path member in the discharging feeding path portion in this embodiment.
Figure 10:
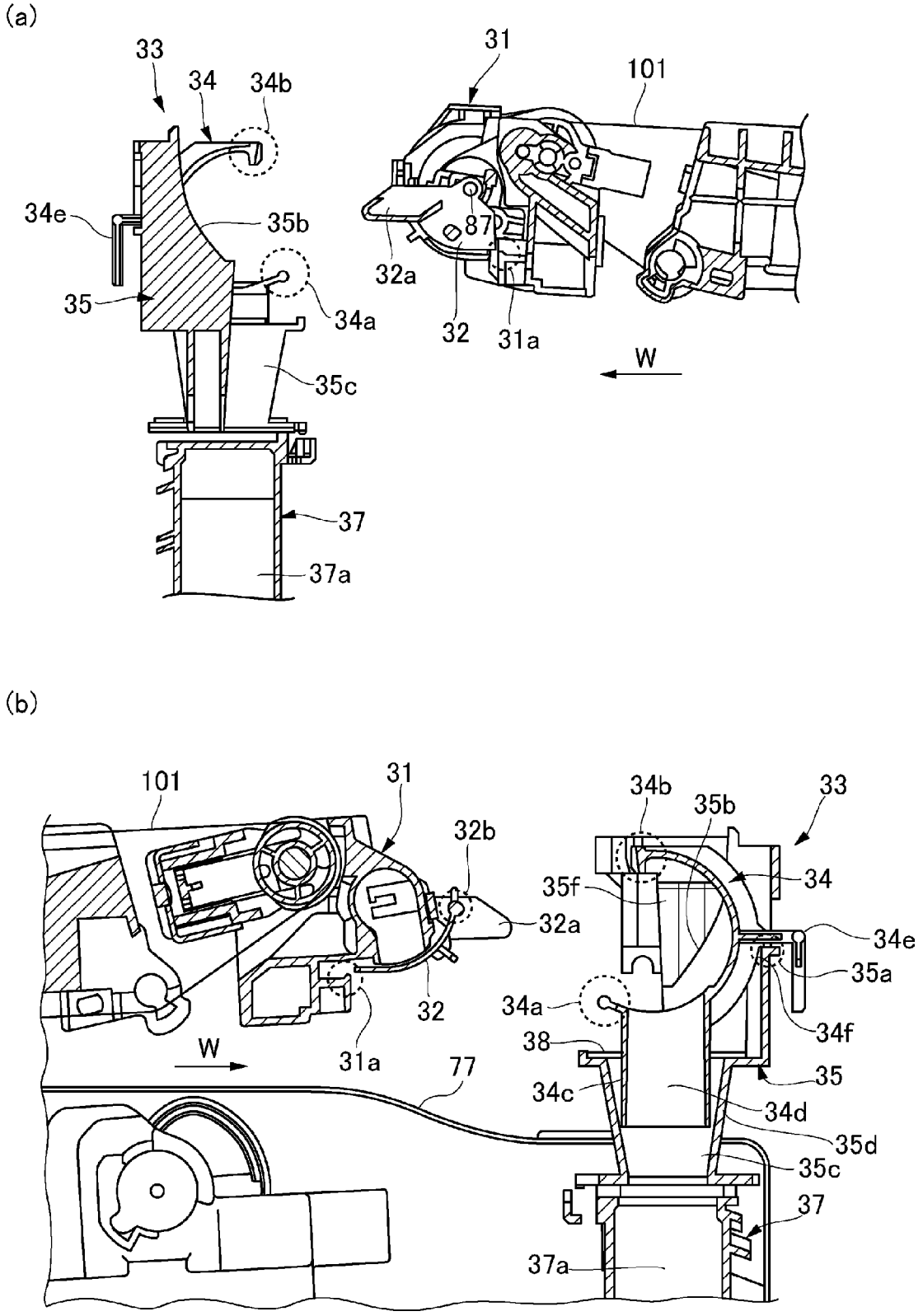
In FIG. 10, (a) is a sectional view of a state before the intermediary transfer belt unit is set in a main assembly A, and (b) is a sectional view as seen from the opposite side.
Figure 11:
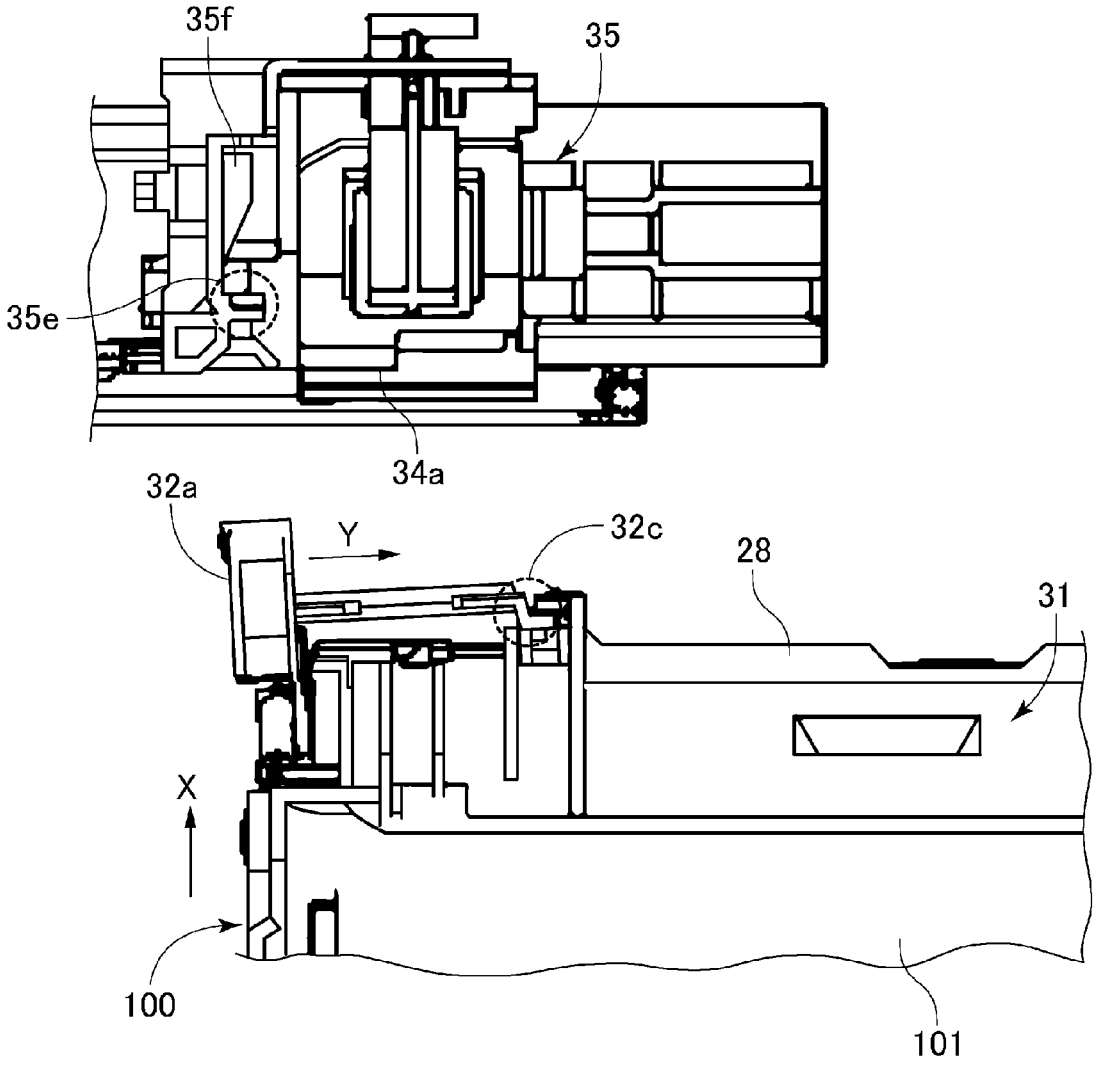
FIG. 11 is a top plan view illustrating a state before the intermediary transfer belt unit is set in the main assembly.
Figure 12:
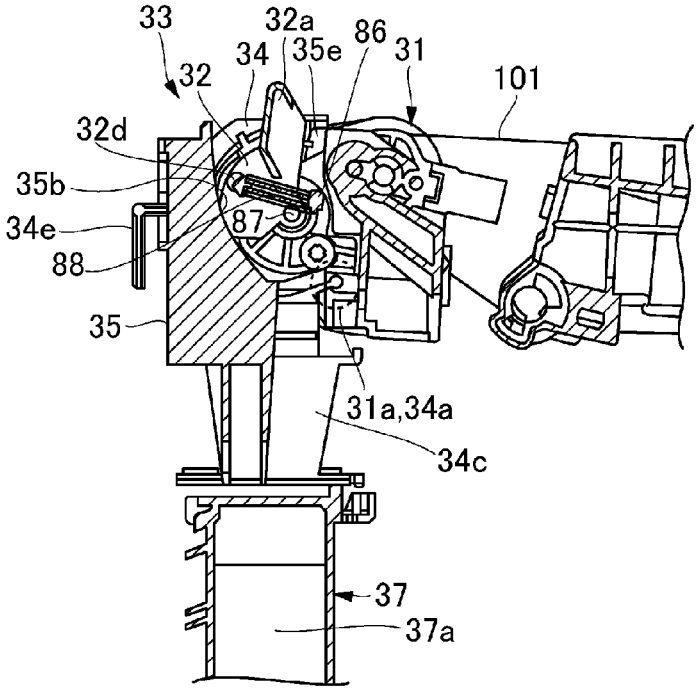
In FIG. 12, (a) is a sectional view illustrating a state after the intermediary transfer belt unit is set in the main assembly, (b) is a sectional view as seen from the opposite side.
Figure 12:
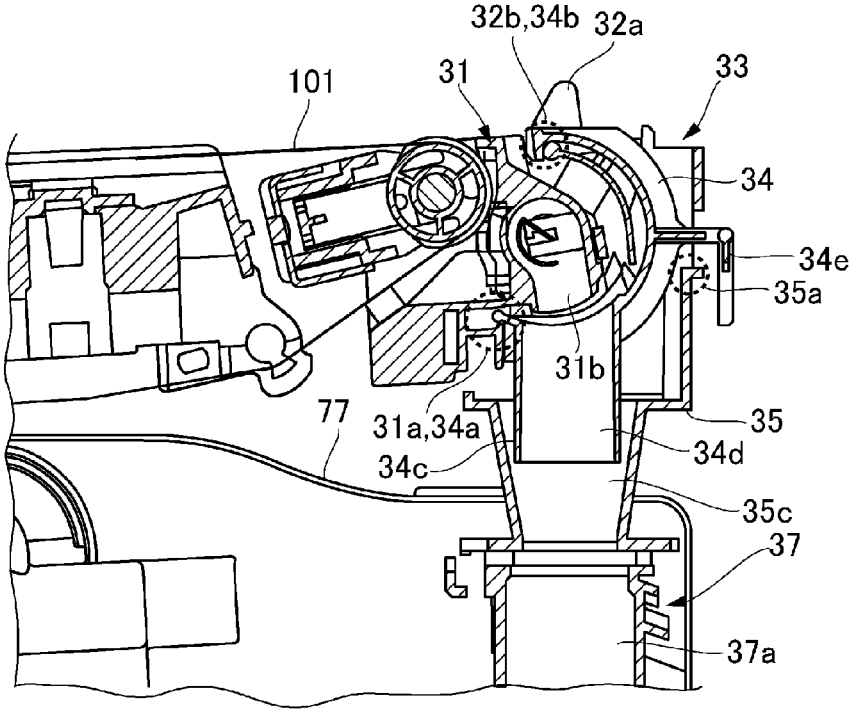

Referring to FIGS. 8-12, the structure of the path portion 33 will be described. Part (a) of FIG. 8 is a perspective view of an entirety of the path portion 33, part (b) is a perspective view of the first path member 34 as shown in part (a). FIG. 9 is a perspective view illustrating the second path member 35 in the path portion 33. Part (a) of FIG. 10 is a sectional view as seen from F side of FIG. 6 in the state before the intermediary transfer belt unit 100 is set in the main assembly 90*a*, and part (b) is a sectional view as seen from a R side (opposite the part (a) of FIG. 10). FIG. 11 is a top plan view in the state before the intermediary transfer belt unit 100 is set in the main assembly 90*a*. Part (a) of FIG. 12 is a sectional view in the state after the intermediary transfer belt unit 100 is set in the main assembly 90*a*, part (b) is a sectional view as seen from the opposite side.

As shown in part (a) of FIG. 8, the path portion 33 includes the first path member 34 and the second path member 35 fixed to the main assembly side of the apparatus and connected with the collection container 37 for fluid communication, and the collection container 37 provided in the main assembly 90*a* and having the opening 37*a*. The path portion 33 is provided with a toggle coil spring 88 (part (a) of FIG. 12) for moving the shutter member 32 between the open position and the blocking position by switching the rotating direction depending on the positional relation relative to the rotational center 87 (part (a) of FIG. 10) of the shutter member 32. As shown in part (a) of FIG. 12, the toggle coil spring 88 is locked at one end portion and the other end portion with a projection 86 provided in the intermediary transfer belt unit 100 side and a projection 32*d* provided on the shutter member 32, respectively.

As shown in part (a) of FIG. 10, the shutter member 32 includes a lever portion 32*a* as a contact portion and a shutter engaging portion 32*b*. Wherein the belt cleaning device 31 is connected with the path portion 33, the lever portion 32*a* slides on the lever contact portion 35*b* (part (a) of FIG. 8, too)

of the second path member 35 to be rotated. The lever contact portion 35*b* constitutes a portion-to-be-contacted to which the lever portion (contact portion) 32*a* abuts to move the shutter member 32. The second path member 35 is provided with an engaging portion 35*e* for being engaged by the lever portion 32*a* as shown in part (a) of FIG. 12 to limit a further rotation. When the belt cleaning device 31 is separated from the path portion 33, the engaging portion 35*e* engages with a free end portion of the lever portion (contact portion) 32*a* to rotate the lever portion 32*a* in the counterclockwise direction in part (a) of FIG. 12 (the direction of closing the shutter member 32).

As shown in FIGS. 8 and 9, the second path member 35 is provided with the lever contact portion 35*b* which is curved so as to move the lever portion 32*a* projecting from the shutter member 32 toward the path portion 33 to switch the position of the toggle coil spring 88 relative to the rotational center 87 (part (a) of FIG. 12). The second path member 35 is provided adjacent to the lever contact portion 35*b* and is provided with a shutter contact portion 35*f* for opening the shutter member 32 covering the discharge opening portion of the belt cleaning device 31.

The path portion 33 is movable in the swing direction of the belt cleaning device 31 relative to the opening 37*a*, and bring the toner discharge opening 31*b* and the opening 37*a* into fluid communication with each other (part (b) of FIG. 12) when it is mounted to the cleaning device 31 to discharge the toner from the toner discharge opening 31*b* into the collection container 37. When the shutter member 32 is rotated to the open position, the first path member 34 is engaged with the belt cleaning device 31 to bring the toner discharge opening 31*b* into fluid communication with the opening 37*a*.

The toggle coil spring 88 and the lever contact portion 35*b* of the second path member 35 constitute a shutter opening and closing mechanism. The shutter opening and closing mechanism moves the shutter member 32 to the open position (the position shown in FIG. 12) in interrelation with the mounting of the belt cleaning device 31 to the path portion 33. And, it moves the shutter member 32 to the blocking position (FIG. 10) in interrelation with the separation of the intermediary transfer belt unit 100 from the main assembly 90*a*.

The shutter member 32 rotates about the rotational center 87 between the open position and the blocking position. The shutter opening and closing mechanism is provided with a toggle coil spring 88 as an urging member for urging the shutter member 32 toward the open position or the blocking position by changing a positional relation relative to the rotational center of the shutter member 32. Furthermore, the shutter opening and closing mechanism is provided with a lever contact portion 35*b* for switching the shutter member 32 between the open position and the blocking position in interrelation with the mounting of the belt cleaning device 31.

Figure 13:
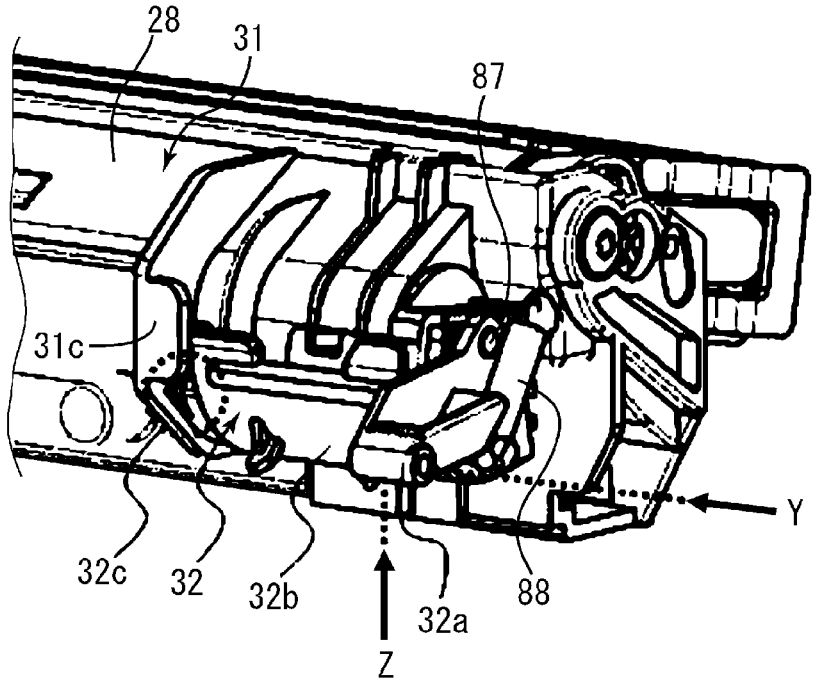
In FIG. 13, (a) is a perspective view of a shutter member and neighborhood thereof in a closed state, and (b) is a perspective view thereof in an open state.
Figure 13:
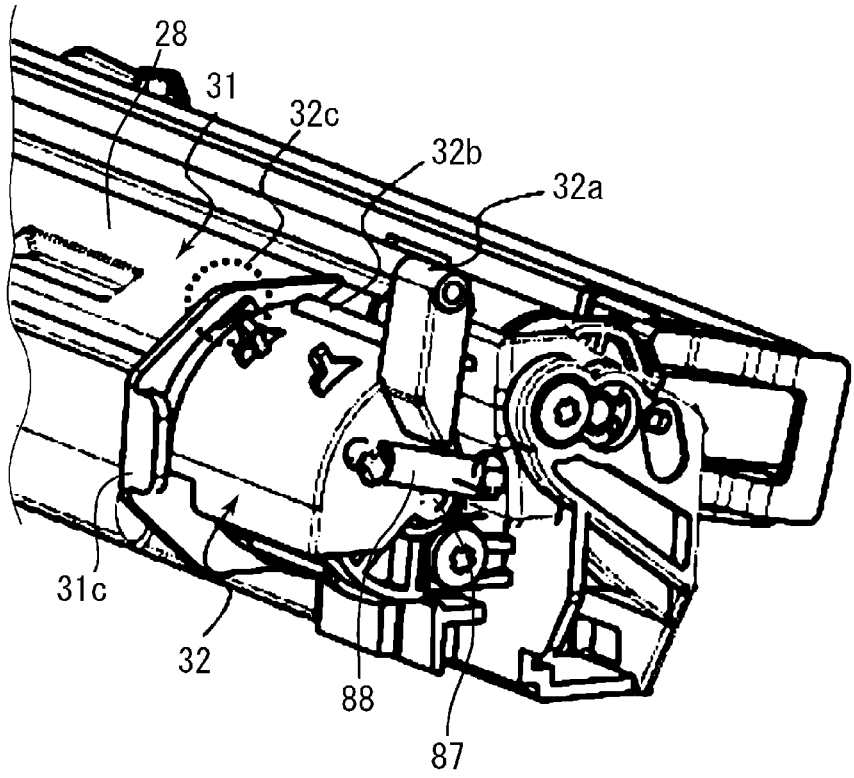

In the closing state of the shutter member 32 shown in parts (a) and (b) of FIG. 13, the shutter member 32 is released by the lever portion 32*a* being pressed in the direction of an arrow Z. At this time, the shutter projection 32*c* functions as a stopper between the belt cleaning device 31 and itself, and the shutter member 32 is not released only by the pressing in the arrow Z direction. By doing so, the shutter member 32 is not opened unintentionally outside of the main assembly 90*a*.

When the shutter member 32 is opened in the main assembly 90*a*, the lever portion 32*a* moves in the direction indicated by an arrow X together with the belt cleaning device 31 as shown in FIG. 11 to approach and slide on the shutter contact portion 35*f* of the second path member 35. By this, the lever portion 32*a* is pressed by the shutter contact portion 35*f* in the direction indicated by an arrow Y (part (a) of FIG. 13) so that the shutter projection 32*c* retracts from the belt cleaning device 31. Therefore, by being placed in the arrow Z direction in the retracted state, the shutter member 32 is released to move to the open position as shown in part (b) of FIG. 13.

As shown in parts (a) and (b) of FIG. 8, the first path member 34 includes the engaging portion 34*a* for engaging with the belt cleaning device 31, the fixed hook portion 34*b*, and the nozzle portion 34*c* communication with the toner discharge opening 31*b* (part (b) of FIG. 12). The first path member 34 is fixed to and is supported by the belt cleaning device 31, by the engaging portion 34*a* and the fixed hook portion 34*b* nip a portion of the belt cleaning device 31. By doing so, the first path member 34 is movable integrally with the steering operation of the steering unit 1.

As shown in FIG. 9, the second path member 35 provided with an attitude holding projection 35*a* (part (b) of FIG. 10) for keeping the attitude of the first path member 34 when the first path member 34 is connected to the belt cleaning device 31.

The first path member 34 is curved toward the belt cleaning device 31 for proper engagement with the belt cleaning device 31, and an upper portion of the curved portion is provided with the fixed hook portion 34*b*, and a lower portion thereof is provided with the engaging portion 34*a*.

The first path member 34 is provided with an engaging hook portion 34*e* projecting from a rear side of the curved configuration portion into a hook shape, for entering and temporarily engagement with an opening 35*g* formed in an upper portion of the attitude holding projection 35*a* of the second path member 35.

The first path member 34 abuts to the attitude holding projection (a predetermined station of the main assembly side of the apparatus) 35*a* before the mounting of the intermediary transfer belt unit 100 to the main assembly 90*a*. After the mounting of the belt unit 100 to the main assembly 90*a*, it separates at attitude holding projection 35*a* to become movable to together with steering unit 1. The state of the first path member 34 being temporarily held is the state temporarily held by the main assembly 90*a*.

Before the mounting of the intermediary transfer belt unit 100 to the main assembly 90*a*, the engaging hook portion 34*e* is inserted into the opening 35*g* by which the rear surface portion 34*f* (part (b) of FIG. 10) abuts to the attitude holding projection 35*a*. As to the mounting of the belt cleaning device 31, the first path member 34 separates the rear surface portion 34*f* from the attitude holding projection 35*a* in the state that the engaging hook portion 34*e* in the opening 35 *g* so as to be movable together with the steering unit 1. In other words, before the mounting of the intermediary transfer belt unit 100 to the main assembly 90*a*, the first path member 34 abuts to the attitude holding projection (predetermined station) 35*a* of the main assembly side of the apparatus and is temporarily held After the mounting of the intermediary transfer belt unit 100 to the main assembly 90*a*, it is connected with the cleaner container 28 and is separated from the attitude holding projection 35*a* to become movable together with the steering unit 1.

In addition, second path member 35 is provided with the lever contact portion 35*b* having an arcuate surface (sliding contact surface) for causing the shutter member 32 covering the toner discharge opening 31*b* of the belt cleaning device 31 to slide on the lever portion 32*a* to open the shutter member 32. The lever contact portion 35*b* is contacted by a lower side (FIG. 9) of the coming lever portion 32*a* and guides it upwardly so as to rotate the lever portion 32*a* in the clockwise direction (part (a) of FIG. 10), thus opening the shutter member 32.

As shown in part (b) of FIG. 10, the cylindrical portion 35*d* is connected with the collection container 37 so as to communicate with the opening 37*a*. The nozzle portion 34*c* of the first path member 34 always overlaps the cylindrical portion 35*d* of the second path member 35 in the direction of height.

The cylindrical portion 35*d* is provided, between the toner receiving port 35*c* and the nozzle portion 34*c* inserted thereinto, with a flexible sheet material 38 as a sealing member for preventing scattering of the collected toner from the toner discharge opening 31*b*. The sheet material 38 has a rectangular shape having two cuts 38*a* along the diagonal lines of the rectangular shape. In the mounted state, the sheet material 38 permits the toner discharge opening 31*b* to enter the toner because of the cuts 38*a*. By the provision of the sheet material 38, the sealing can be accomplished to prevent toner scattering between the opening 37*a* and the toner discharge opening 31*b*.

As shown in parts (a) and (b) of FIG. 10, when the intermediary transfer belt unit 100 is set in the main assembly 90*a*, the shutter member 32 of the intermediary transfer belt unit 100 is closed, and the lever portion 32*a* projects in the horizontal direction toward the second path member 35.

From the state, the intermediary transfer belt unit 100 is inserted in the direction indicated by an arrow A of FIG. 1 while the rear side grip portion 92 (FIG. 6) is gripped by the operator, by which the intermediary transfer belt unit 100 moves in the direction indicated by a arrow W in parts (a) and (b) of FIG. 10. Then, the lever portion 32*a* projecting in the horizontal direction is raised along the arcuate surface of the lever contact portion 35*b* to rotate upwardly, thus opening the shutter member 32.

At this time, the first path member 34 is temporarily held on the path portion 33 side in the state that the rear surface portion 34*f* thereof (part (b) of FIG. 10) contacts the attitude holding projection 35*a* of the second path member 35. With the opening operation of the shutter member 32, the hook portion 34*b* is raised by the shutter engaging portion 32*b* (part (a) of FIG. 12).

At this time, the first path member 34 contacts the attitude holding projection 35*a* so that the pivoting thereof toward the rear side is limited. Therefore, it is assuredly avoided that the first path member 34 inclines away from the intermediary transfer belt unit 100 in the direction indicated by the arrow W with the result of improper connection relative to the belt cleaning device 31.

In the state, the belt cleaning device 31 incoming together with the intermediary transfer belt unit 100 in the direction of the arrow W (FIG. 10) can be properly accepted by the second path member 35 retained in place. By this, the first path member 34 can be assuredly and properly mounted to the belt cleaning device 31.

As shown in parts (a) and (b) of FIG. 12, in the state that the intermediary transfer belt unit 100 is properly set in the main assembly 90*a*, the shutter member 32 is opened to its maximum extent. At this time, the engaging portion 34*a* of the first path member 34 is engaged with the engaging portion 31*a* of the belt cleaning device 31, and therefore, the first path member 34 and the belt cleaning device 31 are assuredly connected with each other.

When the first path member 34 is raised by the shutter member 32 to engage with the belt cleaning device 31, the first path member 34 is spaced from the attitude holding projection 35*a* of the second path member 35. However, because of the length relation by which the nozzle portion 34*c* of the first path member 34 always overlaps the cylindrical portion 35*d* of the second path member 35 in the height direction, the toner from the toner discharge opening 34*d* is assuredly discharged into the toner receiving port 35*c*.

Therefore, even when the belt offset occurs, and the steering unit 1 effects the steering operation, the first path member 34 follows the steering operation, keeping the state in which the first path member 34 always overlaps the second path member 35 in the height direction without contacted thereto. By doing so, the scattering of the collected toner in the path portion 33 can be assuredly suppressed without application of a load to the steering operation of the steering unit 1.

As described hereinbefore, in this embodiment, when the intermediary transfer belt unit 100 is set in the main assembly 90*a*, the shutter member 32 and the path portion 33 are as follows.

Figure 14:
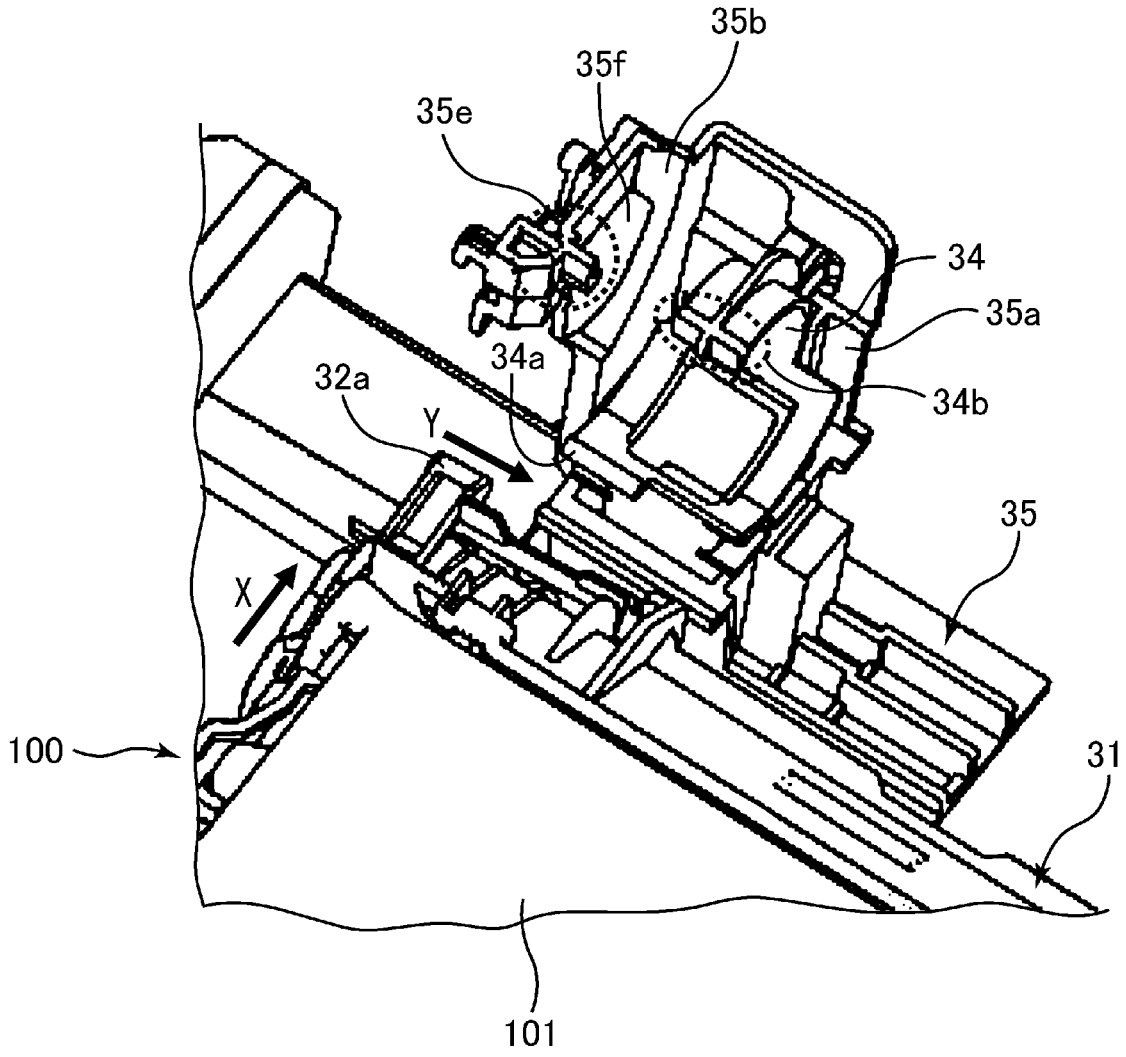
FIG. 14 is a perspective view illustrating a state before the intermediary transfer belt unit is set in the main assembly.

As shown in FIGS. 11 and 14, when the intermediary transfer belt unit 100 is set to the main assembly 90*a*, the shutter member 32 is in the blocking position, wherein the lever portion 32*a* takes a low position. Wherein, from the states, the intermediary transfer belt unit 100 is moved in the direction of the arrow X, the lever portion 32*a* first contacts to the shutter contact portion 35*f* of the second path member 35 to be urged in the direction of the arrow Y.

Figure 16:
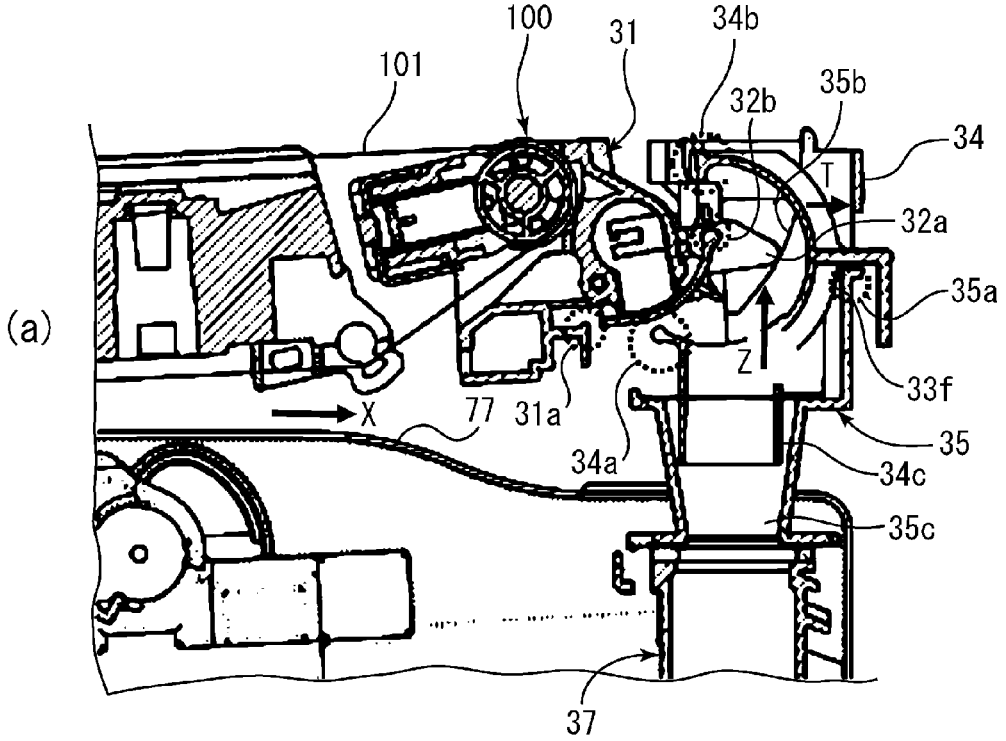
In FIG. 16, (a) is a sectional view illustrating a state partway of setting of the intermediary transfer belt unit to the main assembly.
Figure 16:
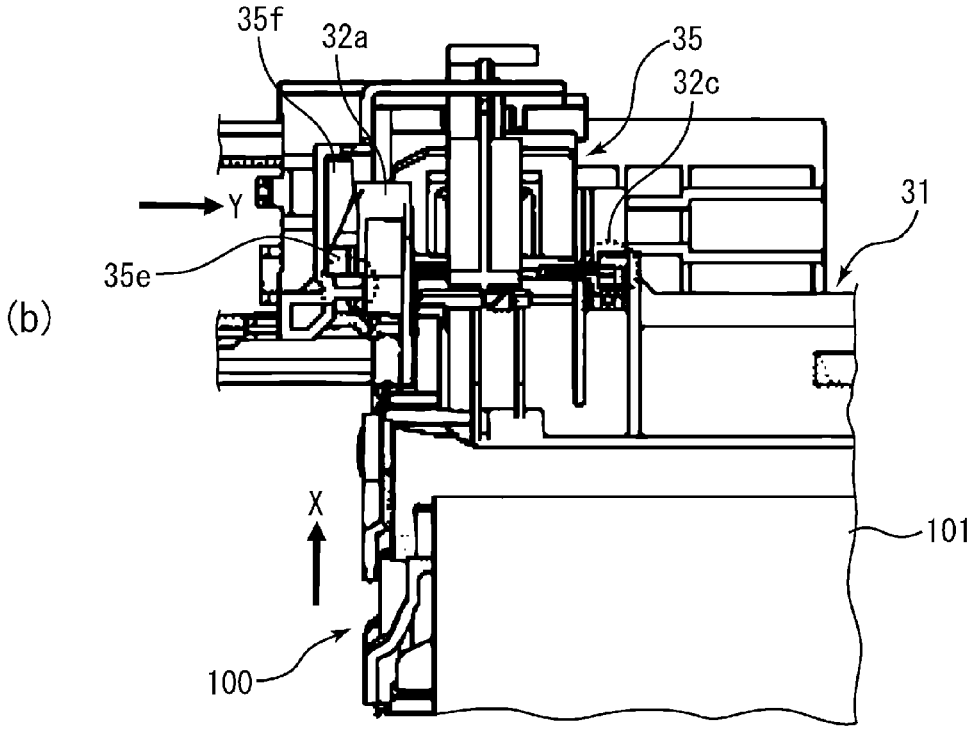

By this, as shown in part (b) of FIG. 16, the shutter projection 32*c* retracts from the engaging claw portion 31*c* (part (a) of FIG. 13) of the belt cleaning device 31. Wherein, in the state, the intermediary transfer belt unit 100 is further moved in the direction of the arrow X, the lever portion 32*a* is rotated along the lever contact portion 35*b* of the second path member 35 is raised in the direction of the arrow Z in part (a) of FIG. 16, so that the shutter member 32 is opened.

Thus, the lever portion 32*a*, the shutter contact portion 35*f*, the engaging claw portion 31*c* and the shutter projection 32*c* constitute a locking mechanism for limiting the movement of the shutter member 32 from the blocking position to the open position. The locking mechanism moves, prior to the movement of the shutter member 32 to the open position, the shutter member 32 in the releasing direction (arrow Y in part (a) of FIG. 13) with the mounting operation of the intermediary transfer belt unit 100 to the main assembly 90*a*. By this, the movement of the shutter member 32 from the blocking position to the open position is permitted. Therefore, it can be avoided that the shutter member 32 is unintentionally opened.

In addition, as shown in part (b) of FIG. 10 and part (a) of FIG. 16, the first path member 34 is set in the second path member 35 in the state that the rear surface portion 34*f* thereof contacts the attitude holding projection 35*a* of the second path member 35. Simultaneously with the opening operation of the shutter member 32, the hook portion 34*b* is raised by the shutter engaging portion 32*b* of the shutter member 32. At this time, since the first path member 34 contacts the attitude holding projection 35*a* of the second path member 35, the second path member 35 is inclined away from the intermediary transfer belt unit 100 (arrow T direction in part (a) of FIG. 16). Therefore, proper connection with the belt cleaning device 31 can be assuredly avoided.

Figure 18:
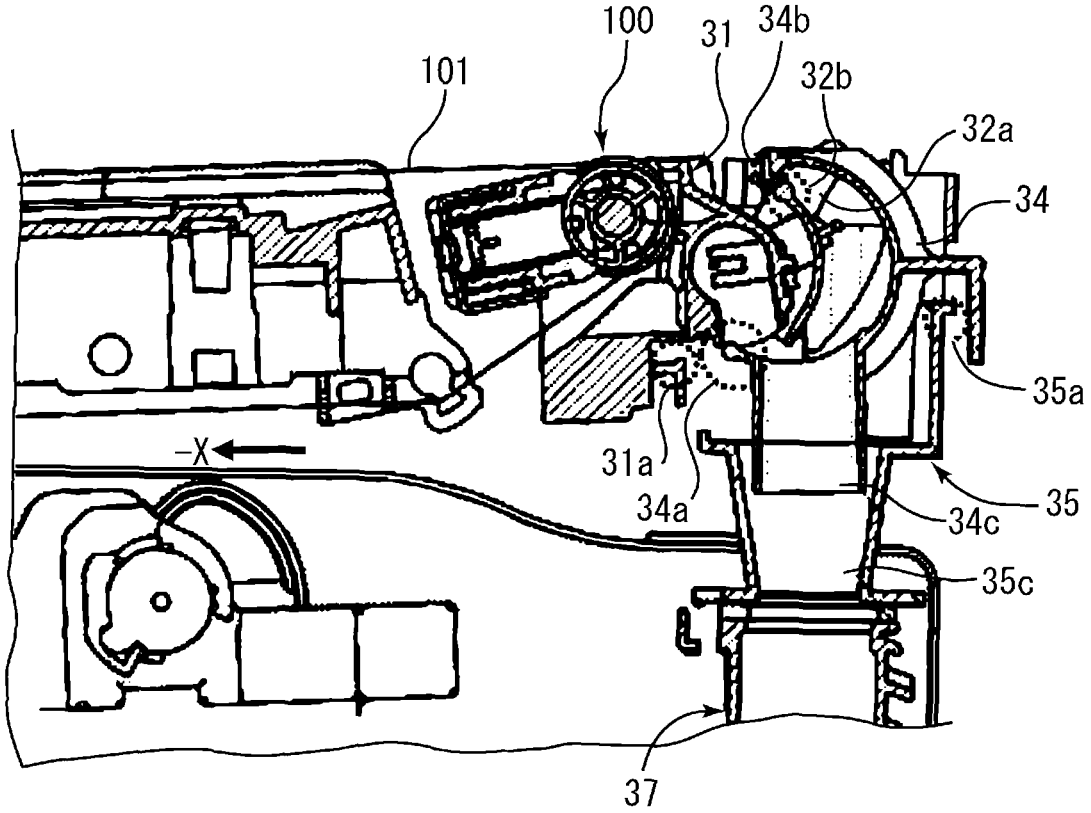
FIG. 18 is a sectional view illustrating a state partway of the removal of the intermediary transfer belt unit from the main assembly.

When the intermediary transfer belt unit 100 is properly set in the main assembly 90*a* (FIG. 18), the shutter member 32 is fully open, and the engaging portion 34*a* of the first path member 34 is engaged with the engaging portion 31*a* of the belt cleaning device 31. Therefore, the first path member 34 and the belt cleaning device 31 are assuredly connected with each other.

When the first path member 34 raised by the shutter member 32 is connected with the belt cleaning device 31, the first path member 34 is spaced from the attitude holding projection 35*a* of the second path member 35. Therefore, even when the belt offset occurs, and the steering unit 1 effects the steering operation, the first path member 34 follows the steering operation, keeping the state in which the first path member 34 always overlaps the second path member 35 in the height direction without being contacted thereto. By doing so, the scattering of the collected toner in the path portion 33 can be significantly suppressed without application of a load to the steering operation of the steering unit 1.

Figure 15:
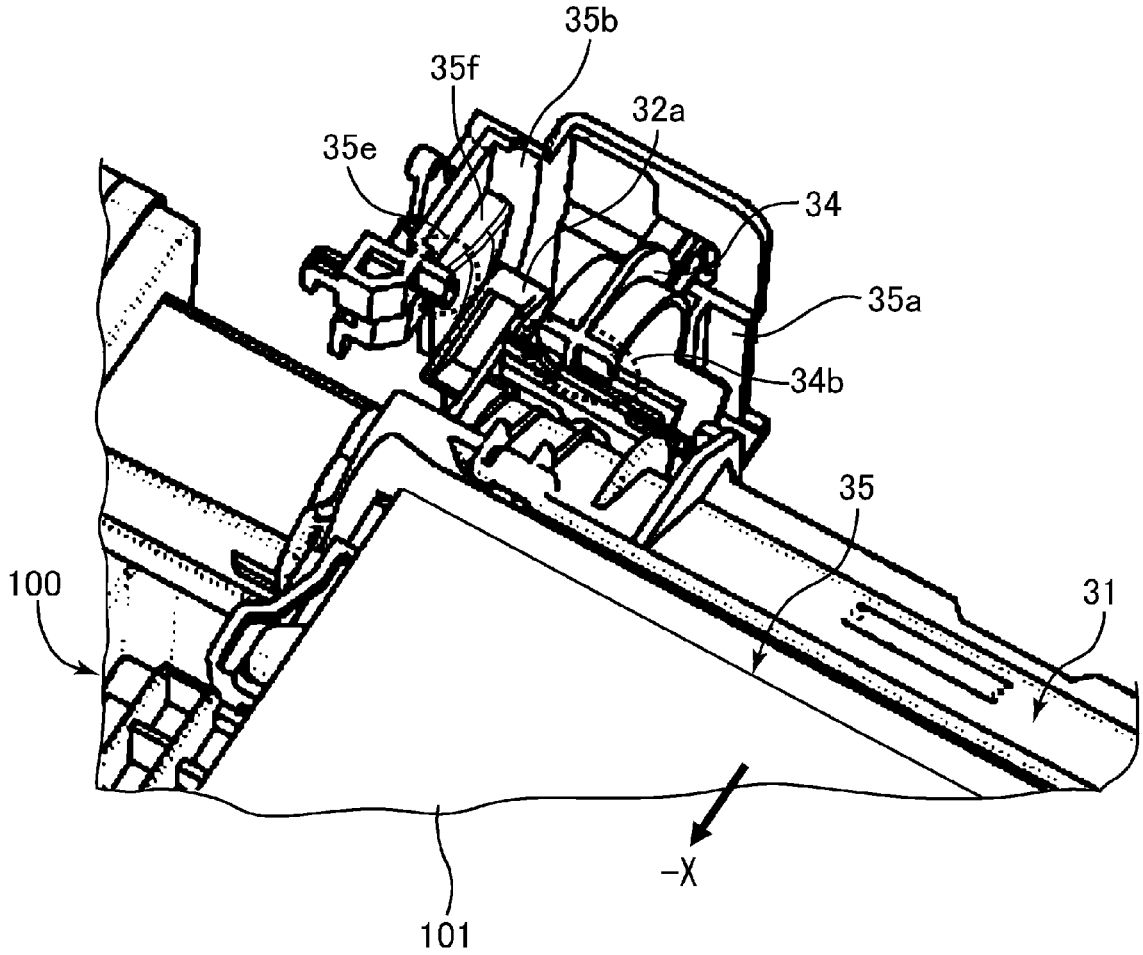
FIG. 15 is a perspective view illustrating a state partway of setting of the intermediary transfer belt unit to the main assembly.
Figure 17:
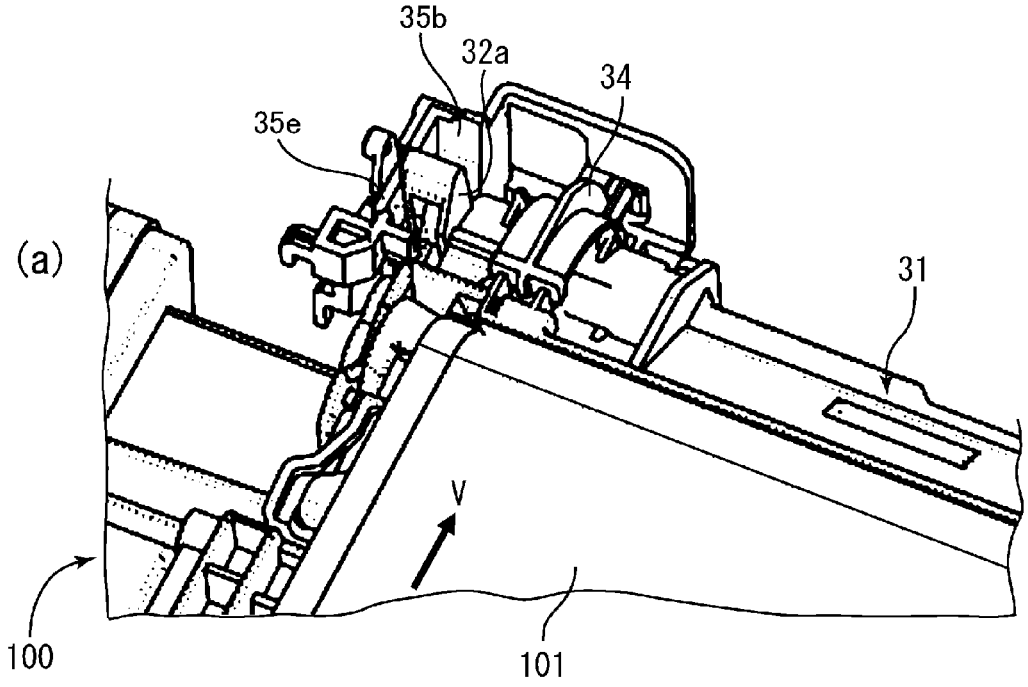
In FIG. 17, (a) is a perspective view illustrating a state after the intermediary transfer belt unit is set in the main assembly, (b) is a perspective view illustrating a state partway of the removal of the intermediary transfer belt unit from the main assembly.
Figure 17:
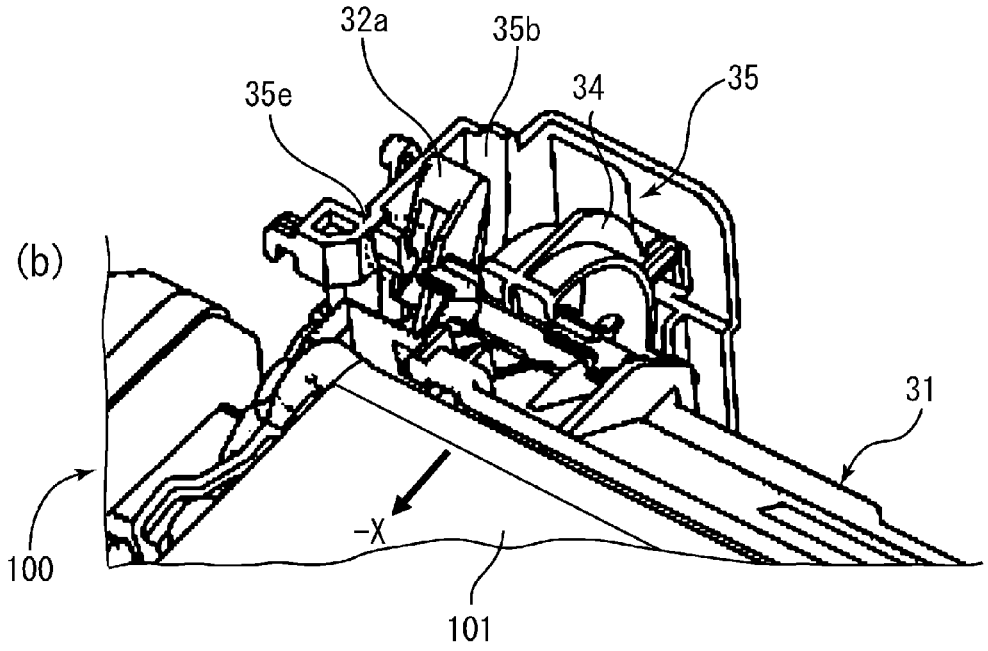

On the other hand, when the intermediary transfer belt unit 100 is dismounted from the main assembly 90*a*, the intermediary transfer belt unit 100 is moved in the direction of –X as shown in FIG. 15 and part (b) of FIG. 17, by which it can be relatively easily dismounted. At this time, the lever portion 32*a* of the shutter member 32 abuts the engaging portion 35*e* of the second path member 35, so that it is pressed in the direction opposite to the dismounting direction of the intermediary transfer belt unit 100, by which the shutter member 32 is assuredly moved to the blocking position.

As described in the foregoing, according to this embodiment, the path portion 33 connects the toner discharge opening 31*b* and the opening 37*a* with each other in the state of being mounted to the belt cleaning device 31. By this, the collected toner scattering in the relaying portion can be reduced without application of load to the steering operation even when the positions of the cleaning blade 102 and the belt cleaning device 31 relative to the path portion 33 change due to the steering operation.

That is, according to this embodiment, the path portion 33 between the belt cleaning device 31 supported by the intermediary transfer belt unit 100 and the collection container 37 of the main assembly 90*a* has the following structure. The path portion 33 comprises the first path member 34 engaged with the belt cleaning device 31, and the second path member 35 which overlaps the first path member 34 in the height direction without contact.

When the intermediary transfer belt unit 100 is set into the main assembly 90*a*, the belt cleaning device 31 and the first path member 34 are engaged with each other assuredly. Therefore, the toner scattering in the path portion 33 can be assuredly prevented without application of load to the steering operation even when the positions of the steering unit 1 and the belt cleaning device 31 change due to the steering operation.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 198928/2013 filed Sep. 25, 2013, which is hereby incorporated by reference.

What is claimed is:

1. An image forming apparatus comprising:

a main assembly;

a belt unit detachably mountable to said main assembly, said belt unit including a movable endless belt, a supporting roller, a steering unit, and a cleaning unit, wherein said supporting roller supports said endless belt, and said steering unit supports said endless belt and is configured to be inclined relative to said supporting roller so as to move said endless belt in a first widthwise direction perpendicular to a moving direction of said endless belt by a force produced by movement of said endless belt in a second widthwise direction opposite to the first widthwise direction, and wherein said cleaning unit is supported by said steering unit and is configured to remove and collect toner from said endless belt, said cleaning unit including a discharge opening configured to discharge the collected toner;

an image forming station configured to form a toner image on said endless belt;

a toner container including a receiving opening portion at a cleaning unit side, said toner container being provided in said main assembly and configured to contain the toner collected by said cleaning unit; and a path member configured to guide the toner collected by said cleaning unit to said toner container, including a first opening portion disposed at said cleaning unit side and a second opening portion disposed at said toner container side, wherein in a state that said belt unit is dismounted from said main assembly, said path member is supported by said main assembly, and wherein in a state that said belt unit is mounted to said main assembly, said path member is not supported by said main assembly, and is connected with said steering unit to be integrally movable with inclination of said steering unit, the first opening portion is disposed at a position corresponding to the discharge opening, and the second opening portion is disposed at a position inside the receiving opening portion such that the second opening portion does not contact the receiving opening portion when being moved by the inclination of said steering unit.

2. An apparatus according to claim 1, further comprising:

a feeding member configured to feed the removed toner to said discharge opening;

a shutter member configured to open and close said toner discharge opening; and a shutter opening and closing mechanism configured to move said shutter member to an opening position for opening said discharge opening and to a closing position for closing said discharge opening, in interrelation with a mounting operation and a disengaging operation of said belt unit relative to said main assembly, respectively, wherein said path member is supported by said cleaning unit by said shutter member urging said path member toward said cleaning unit with the mounting operation.

3. An apparatus according to claim 2, wherein said shutter opening and closing mechanism includes an urging member configured to urge said shutter member toward the opening position, and said path member is supported by said cleaning unit by an urging force of said urging member.

4. An apparatus according to claim 2, wherein said shutter opening and closing mechanism includes a portion-to-be-contacted configured to move said shutter member to the opening position by contact to a contact portion provided on said shutter member with the mounting operation of said belt unit to said main assembly.

5. An apparatus according to claim 2, wherein said shutter opening and closing mechanism includes a second portion-to-be-contacted configured to move said shutter member to the closing position by contact to a contact portion provided on said shutter member with the dismounting operation of said belt unit from said main assembly.

6. An apparatus according to claim 3, wherein said shutter opening and closing mechanism is provided with a locking mechanism configured to limit movement of said shutter member from the closing position to the opening position, said locking mechanism unlocking with the mounting operation of said belt unit to said main assembly to permit movement of said shutter member from the closing position to the opening position.

7. An apparatus according to claim 2, wherein said path member is contacted with a predetermined portion of said main assembly before said belt unit is mounted to said main assembly, and is supported by said cleaning unit away from the predetermined portion and is inclined together with said steering unit after said belt unit is mounted to said main assembly.

8. An apparatus according to claim 1, wherein the second opening portion is provided with a first cylindrical portion configured to pass the toner, the receiving opening portion is provided with a second cylindrical portion for receiving said first cylindrical portion, wherein said first cylindrical portion and said second cylindrical portion have regions in which said first cylindrical portion and said second cylindrical portion overlap with each other in the direction from said path member to said toner container without contact from each other.

9. An apparatus according to claim 8, wherein a path member side of said second cylindrical portion is provided with a flexible sealing member surrounding said first cylindrical portion to prevent the toner from scattering.

10. An apparatus according to claim 1, wherein said steering unit includes a follower roller rotated by said endless belt, a fixed member provided at each of the opposite axial end portions of said follower roller so as not to move relative to the rotation of said endless belt, and a supporting member for rotatably supporting said follower roller and said fixed member so as to be rotatable about a rotational axis extending in a direction crossing with a rotational axis of said follower roller.

* * * * *